US006481833B1

(12) United States Patent
Fujii et al.

(10) Patent No.: US 6,481,833 B1
(45) Date of Patent: Nov. 19, 2002

(54) INKJET PRINTER

(75) Inventors: Masahiro Fujii, Shiojiri (JP); Hiroyuki Ishikawa, Shiojiri (JP); Yasushi Matsuno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/635,997

(22) Filed: Aug. 9, 2000

(30) Foreign Application Priority Data

Aug. 9, 1999 (JP) ..... 11-225809
Apr. 28, 2000 (JP) ..... 2000-129934

(51) Int. Cl.[7] ..... B41J 2/045
(52) U.S. Cl. ..... 347/68; 347/69
(58) Field of Search ..... 347/68, 70, 69

(56) References Cited

U.S. PATENT DOCUMENTS 5,510,819 A 4/1996 Fujimoto et al.
6,234,608 B1 * 5/2001 Genovese et al. ..... 347/54

FOREIGN PATENT DOCUMENTS

| | | |
|---|---|---|
| EP | 0 816 081 A | 1/1998 |
| EP | 0 919 382 A | 6/1999 |
| JP | 02-187352 | 7/1990 |
| JP | 02-289351 | 11/1990 |
| JP | 03-256746 | 11/1991 |
| JP | 05-031896 | 2/1993 |
| JP | 5-305710 | 11/1993 |
| JP | 08-295014 | 11/1996 |
| JP | 09-150506 | 6/1997 |

* cited by examiner

*Primary Examiner*—Thinh Nguyen
(74) *Attorney, Agent, or Firm*—Mark P. Watson

(57) ABSTRACT

Undesirable deflection of partitioning walls between ink pressure chambers is prevented during ink discharge operations even when the partitioning walls are made very thin to achieve a high density inkjet head. The diaphragms of the discharge nozzles of the inkjet head as well as the diaphragms of the non-discharge nozzles are all driven to contact the corresponding individual electrodes, and this diaphragm to individual electrode contact state is maintained in the non-discharge nozzles while the diaphragms of the discharge nozzles are released from individual electrodes to discharge ink. After printing is completed the diaphragms of the non-discharge nozzles are slowly released from the corresponding individual electrodes at a speed that will not cause undesirable ink discharge. By thus maintaining low compliance in the ink pressure chambers of the non-discharge nozzles, deformation of the partitioning walls between discharge and non-discharge nozzles due to change in the ink pressure can be reliably prevented. A drop in ink discharge performance due to such partitioning wall deformation can be reliably prevented, and printing with high resolution, precise print quality can be easily achieved.

15 Claims, 13 Drawing Sheets

DISCHARGE STEP

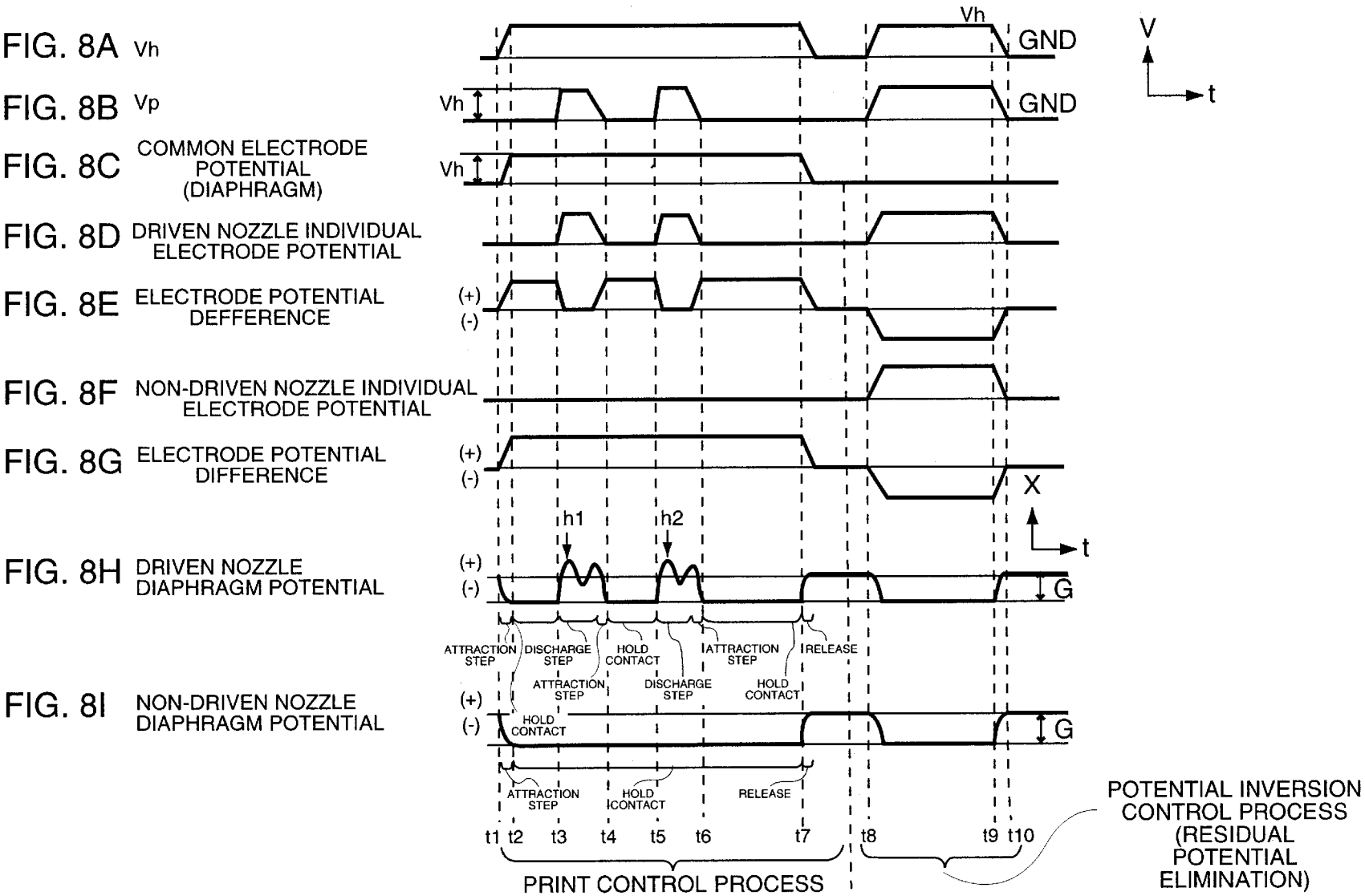
FIG. 8A Vh
FIG. 8B Vp
FIG. 8C COMMON ELECTRODE POTENTIAL (DIAPHRAGM)
FIG. 8D DRIVEN NOZZLE INDIVIDUAL ELECTRODE POTENTIAL
FIG. 8E ELECTRODE POTENTIAL DEFFERENCE
FIG. 8F NON-DRIVEN NOZZLE INDIVIDUAL ELECTRODE POTENTIAL
FIG. 8G ELECTRODE POTENTIAL DIFFERENCE
FIG. 8H DRIVEN NOZZLE DIAPHRAGM POTENTIAL
FIG. 8I NON-DRIVEN NOZZLE DIAPHRAGM POTENTIAL
V
t
Vh
GND
Vp
(+)
(-)
X
G
h1
h2
ATTRACTION STEP
DISCHARGE STEP
HOLD CONTACT
RELEASE
t1
t2
t3
t4
t5
t6
t7
t8
t9
t10
PRINT CONTROL PROCESS
POTENTIAL INVERSION CONTROL PROCESS (RESIDUAL POTENTIAL ELIMINATION)

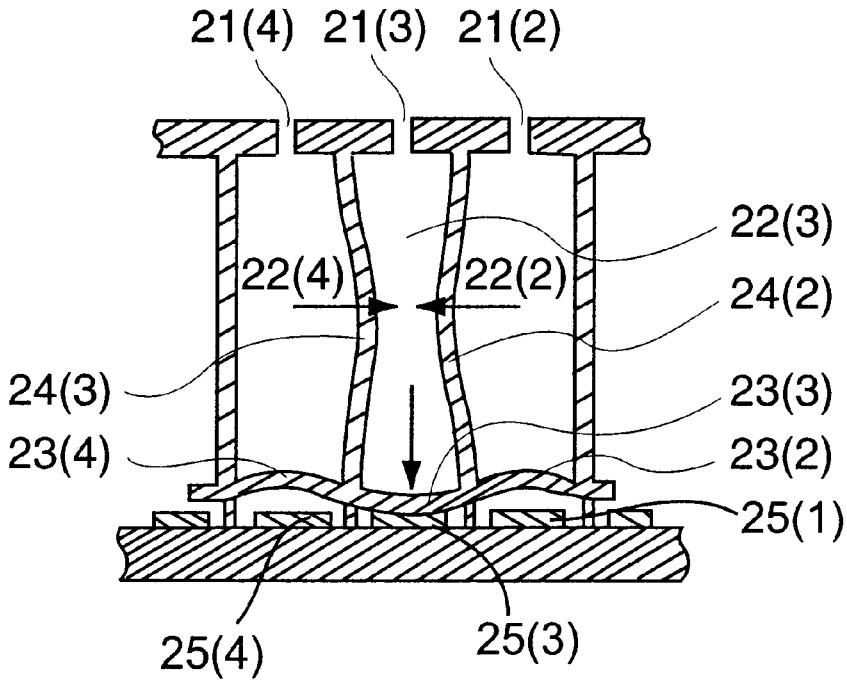
FIG. 13A DIAPHRAGM ATTRACTION
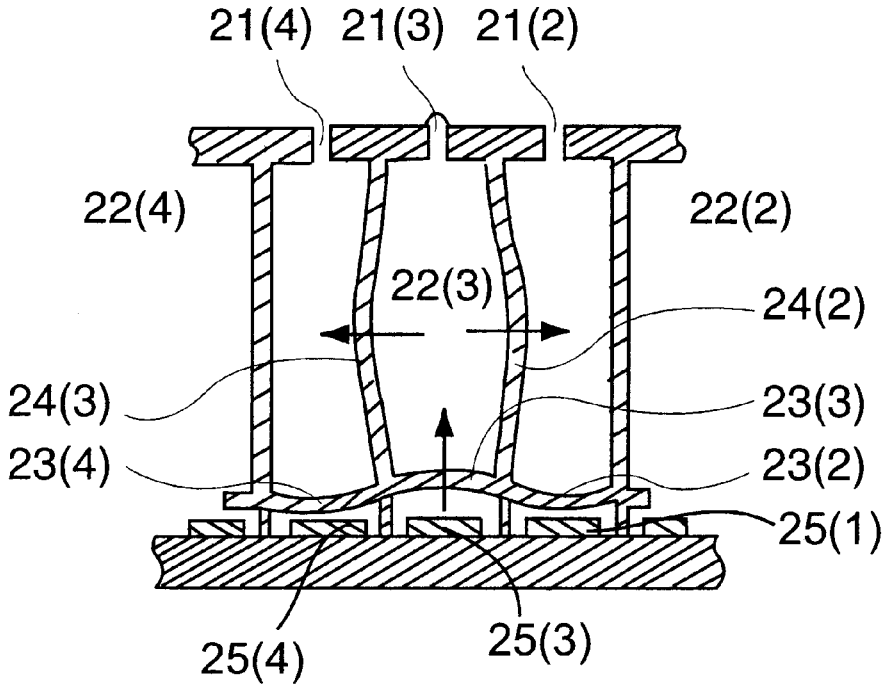
FIG. 13B INK DISCHARGE

INKJET PRINTER

BACKGROUND OF THE INVENTION

1. Field of the Invention

Our invention relates to a driving method for an electrostatic inkjet head whereby ink drops are ejected from ink nozzles communicating with an ink pressure chamber by flexibly displacing the diaphragm of the ink pressure chamber by means of electrostatic force. More particularly, our invention relates to a method and/or a device for driving an electrostatic inkjet head so that ink pressure crosstalk between adjacent ink pressure chambers is prevented even when the ink pressure chambers are formed in a high density arrangement. Our invention also relates to an inkjet printer having such a driving device or employing such method.

2. Description of the Related Art

As taught in Japanese Unexamined Patent Application (kokai) 2-289351, for example, an electrostatic inkjet head has a diaphragm, which is a resonance electrode formed on the bottom of each ink pressure chamber part of the ink path, and an electrode plate, which is an individual electrode disposed opposite the diaphragm with a specific small gap therebetween. The internal volume of the ink pressure chamber is changed by applying a specific drive voltage between these opposing electrodes of a desired ink nozzle to produce the electrostatic force causing the diaphragm to bend. The resulting change in ink pressure is used to eject an ink drop from the ink nozzle communicating with the driven ink pressure chamber, thereby recording on an opposing recording medium.

A large number of ink nozzles must be disposed in a high density arrangement in order to achieve high quality output from this type of electrostatic inkjet head. This requires a similarly high density arrangement of the ink paths communicating with the ink nozzles, and more specifically the ink pressure chambers associated with the ink nozzles. The walls partitioning the ink pressure chambers by necessity must therefore be extremely thin.

A problem that arises when the walls dividing the ink pressure chambers are very thin is that a change in pressure in the ink pressure chamber can cause the partitioning wall to bend. That is, as shown in FIG. 13A, when diaphragm 23(3) of ink pressure chamber 22(3), in communication with driven ink nozzle 21(3) from which an ink drop is to be discharged, is attracted to individual electrode 25(3), partitioning walls 24(2) and 24(3) might bend as a result of the internal pressure change in the ink pressure chamber 22(3).

As shown in FIG. 13B, when diaphragm 23(3) separates from individual electrode 25(3) when an ink drop is discharged, partitioning walls 24(2) and 24(3) can likewise bend as a result of the internal pressure change in the ink pressure chamber 22(3).

When the partitioning walls bend during ink discharge, pressure loss occurs in ink pressure chamber 22(3), and an ink drop of the desired volume or diameter may not be discharged from the driven ink nozzle 21(3).

Furthermore, when partitioning walls 24(2) and 24(3) between the driven ink nozzle 21(3) and adjacent non-driven ink nozzles 21(2) and 21(4) bend, pressure change also occurs in the ink pressure chambers 22(2) and 22(4) of the non-driven ink nozzles. This pressure change can produce a further undesired discharge of a very small ink drop from a non-driven ink nozzle.

Moreover, as a result of a pressure change leaking to an adjacent ink pressure chamber through intervening partitioning walls 24(2) and 24(3), or in other words due to the resulting ink pressure crosstalk, the internal pressure change occurring in the ink pressure chamber of the driven ink nozzle will differ according to whether an adjacent ink nozzle is simultaneously driven or not driven. As a result, the ink discharge characteristics (ink discharge speed and volume) of the driven ink nozzle vary according to the drive status of an adjacent ink nozzle, leading possibly to a drop in print quality.

A method for avoiding these problems is taught, for example, in Japanese Unexamined Patent Application (kokai) 5-69544 and 7-17039. The methods taught address these problems in an inkjet head in which the ink nozzles are arranged in line by using a delay circuit to offset the ink drop eject timing when adjacent even and odd numbered ink nozzles are driven to print on the same line.

This method, however, complicates the inkjet head driver circuit, and thus introduces new problems, specifically increased cost and slower printing because more time is required to print from adjacent ink nozzles.

In addition to the above problems, ink discharge characteristics can deteriorate due to pressure crosstalk between the ink pressure chambers of non-adjacent ink nozzles. That is, the ink pressure chambers of the individual ink nozzles generally communicate with a common ink chamber. Ink pressure crosstalk can thus be relayed between non-adjacent ink pressure chambers by way of this common ink chamber, thus degrading ink discharge characteristics and preventing normal, stable ink drop discharge.

OBJECTS OF THE INVENTION

With consideration for the aforementioned problems, an object of our invention is to provide a method and a device for driving an electrostatic inkjet head so that ink discharge operations can be accomplished without bending partitioning walls between ink pressure chambers, thereby preventing pressure crosstalk between ink pressure chambers even in high density arrangements, and assuring high resolution, precise print quality.

A further object of our invention is to provide a method and a device for driving an electrostatic inkjet head so that ink discharge operations can be accomplished without bending partitioning walls between ink pressure chambers and without inviting complication of the inkjet head driver circuit or a drop in printing speed. Our invention can thus prevent pressure crosstalk between ink pressure chambers even in high density arrangements, and easily assure high resolution, precise print quality.

A yet further object of our invention is to provide a method and a device for driving an electrostatic inkjet head for preventing pressure crosstalk between ink pressure chambers communicating with the ink nozzles, and easily assuring high resolution, precise print quality, even when a large number of ink nozzles is arranged in line.

A yet further object of our invention is to provide a printer employing our novel electrostatic inkjet head driver device.

SUMMARY OF THE INVENTION

To achieve these objects, the drive method of our invention applies to an electrostatic inkjet head having at least first and second ink pressure chambers separated by a partitioning wall, first and second ink nozzles communicating respectively with the ink pressure chambers, first and second diaphragms that are flexibly displaceable and form part of a wall of the first and second ink pressure chambers, and first and second individual electrodes opposing the diaphragms. An ink drop is discharged from the first ink nozzle by applying a drive voltage between the first diaphragm and first individual electrode to flexibly displace the first diaphragm. Our drive method has a second diaphragm attracting step for attracting the second diaphragm to the second individual electrode and maintaining contact therebetween; and a discharge step for flexibly displacing (releasing) the first diaphragm to discharge an ink drop from the first ink nozzle.

To discharge an ink drop from a first ink nozzle, that is, a driven ink nozzle, the electrostatic inkjet head drive method of our invention holds the diaphragm of the second ink pressure chamber communicating with the second ink nozzle, which is non-driven and does not discharge, attracted to and in contact with the corresponding second individual electrode. Elastic displacement of the second diaphragm is thus restricted and the rigidity of the second ink pressure chamber walls is high so that compliance of the second ink pressure chamber is low. As a result, movement and bending of the partitioning wall separating the second non-discharge ink pressure chamber and the driven (discharge) first ink pressure chamber is prevented or suppressed.

The partitioning walls between the ink pressure chambers are typically about 15 $\mu$m thick and the nozzle plate is about 77 $\mu$m thick, but the diaphragm is much thinner, typically about 0.8 $\mu$m thick. When pressure is applied to the ink inside the ink pressure chamber of a discharge nozzle, the pressure is transmitted through the partitioning wall to the ink in the ink pressure chamber of the adjacent non-discharge nozzle, to the diaphragm, and to the nozzle plate.

If the diaphragm of the non-discharge nozzle is free and not in contact with the corresponding electrode, the diaphragm, which is thinner than the nozzle plate, will bend. Because the transfer of pressure from the discharge nozzle is not interrupted, the partitioning wall also bends. As a result, ink pressure in the pressure chamber of the discharge nozzle works to bend the partitioning wall rather than discharge ink from the nozzle.

However, if the diaphragm is held in contact with the electrode, pressure from the discharge nozzle propagates to the diaphragm through the partitioning wall, but because the diaphragm does not bend the partitioning wall also does not bend. The net effect is that the propagation of pressure from one pressure chamber to the next is prevented, and crosstalk from the discharge nozzle to a non-discharge nozzle does not occur.

The drive method of our invention typically also has a first diaphragm attracting step for attracting the first diaphragm to the first individual electrode and maintaining contact therebetween; and accomplishes the first diaphragm attracting step and second diaphragm attracting step simultaneously.

Yet further preferably there is a second diaphragm release step for releasing contact between the second diaphragm and second individual electrode after the discharge step, the second diaphragm separating from the second individual electrode and returning to a neutral position at a speed that will not cause ink discharge from the second ink nozzle.

Yet further preferably the drive method of our invention has the above noted second diaphragm attracting step, discharge step, second diaphragm attraction holding step, first diaphragm attracting step, and an electrode contact restoring step for restoring contact between the first diaphragm and first individual electrode after the discharge step. In this case the second diaphragm attraction holding step includes a step for maintaining second diaphragm contact after the discharge step.

The electrostatic inkjet head drive method of our invention attracts the diaphragms of all driven and non-driven ink nozzles to the corresponding individual electrodes, and maintains this contact in the non-driven ink nozzles even when ink is discharged from a driven first ink nozzle. Flexible displacement of the second diaphragm, that is, non-driven ink nozzle, is thus restricted during ink nozzle discharge and is held in a high rigidity state so that compliance of the second ink pressure chamber is low. Deflection of the partitioning wall separating the second ink pressure chamber and first ink pressure chamber is thus inhibited, and pressure crosstalk through the partitioning wall is prevented or suppressed.

Yet further preferably, the electrostatic inkjet head drive method of our invention has a release step for releasing the first and second diaphragms from contact with the respective first and second individual electrodes after the electrode contact restoring step, wherein the first and second diaphragms separate from the respective first and second individual electrodes and return elastically to the neutral position at a speed that will not cause ink discharge from the corresponding ink nozzle. In other words, all diaphragms are returned to the initial neutral position once the entire printing process is completed.

The second diaphragm can typically be held in contact with the second individual electrode by maintaining a constant potential difference therebetween for the period from the first and second diaphragm attracting steps to the final release step. It is also sufficient to hold the first and second diaphragms at a constant potential from the first and second diaphragm attracting steps to the final release step, and simply apply a suitable drive voltage to the first individual electrode to accomplish the discharge step. In this case it is preferable to add a residual charge elimination step to eliminate any residual charge between the first diaphragm and individual electrode and between the second diaphragm and individual electrode after the final release step.

To avoid unstable ink drop discharge from non-adjacent ink nozzles, nondischarge nozzles other than the adjacent second ink nozzles are preferably driven and controlled in the same way as the second ink nozzle.

Our invention also relates to an electrostatic inkjet head driver device, and is a driver device for an electrostatic inkjet head in which ink drops are discharged by means of the drive method of our invention. Our driver device has a switching device or circuit for switching the potential of the first and second diaphragms, and the potential of the first and second individual electrodes; a drive pulse generator for producing a drive pulse; and a controller for controlling driving the first and second ink nozzles by changing the drive pulse generated by the drive pulse generator by way of the switching device.

Yet further, our invention relates to an inkjet printer having an electrostatic inkjet head with a plurality of ink nozzles, a transportation device for moving the electrostatic inkjet head relative to a recording medium, and a driver for driving the electrostatic inkjet head synchronized to relative movement by the transportation device, and printing by discharging an ink drop from an ink nozzle by applying a drive voltage between a diaphragm and opposing fixed individual electrode to elastically deform the diaphragm through electrostatic force. The driver of this inkjet printer attracts the diaphragm of a non-discharge ink nozzle to the opposing individual electrode, and elastically displaces the diaphragm of a discharge nozzle while maintaining contact between the diaphragm and individual electrode of the non-discharge nozzle to discharge an ink drop from the discharge nozzle. Note that in the non-discharge nozzle is an ink nozzle from which ink is not discharged, and the discharge nozzle is an ink nozzle from which ink is discharged.

The driver can further operate to establish contact between the diaphragms and respective individual electrodes of the discharge and non-discharge nozzles, elastically displace the diaphragm of the discharge nozzle from contact with the individual electrode, and thereby discharge an ink drop from a desired discharge nozzle.

Our invention also provides an inkjet head having a nozzle opening, ink pressure chamber communicating with the nozzle opening, diaphragm that deflects to discharge ink in the ink pressure chamber from the nozzle opening, and a fixed member to which the diaphragm is fixed by application of an external force to the diaphragm. In this inkjet head the diaphragm is bent to discharge ink in the ink pressure chamber from the nozzle when ink is to be discharged from the nozzle opening, and when ink is to not be discharged from the nozzle opening, the diaphragm is maintained in fixed contact with the fixed member.

Our invention yet further provides a drive method for an inkjet head having a nozzle opening, ink pressure chamber communicating with the nozzle opening, diaphragm that deflects to discharge ink in the ink pressure chamber from the nozzle opening, and a fixed member to which the diaphragm is fixed by application of an external force to the diaphragm, wherein: the diaphragm is bent to discharge ink in the ink pressure chamber from the nozzle when ink is to be discharged from the nozzle opening, and when ink is to not be discharged from the nozzle opening, the diaphragm is maintained in fixed contact with the fixed member.

Our invention can thus also be applied to inkjet heads, such as inkjet heads using piezoelectric elements, which discharge ink by vibrating a diaphragm.

By independently driving the diaphragms of non-discharge nozzles to contact the corresponding individual electrode, changes in ink pressure in the ink chamber of the non-discharge nozzle can be prevented from having a deleterious effect on ink discharge. It is therefore not necessary to print from adjacent nozzles by offsetting the ink discharge timing.

If there is one weak spot in the ink path of the non-discharge nozzle, pressure will concentrate on that spot, ink will move, and the partitioning wall will also move. However, by fixing the diaphragm, which is the weakest part of the ink path, to the individual electrode, the diaphragm becomes effectively more rigid, and the overall ink path also becomes more rigid. As a result, the partitioning wall will no longer move.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIGS. 8A to 8I form a timing chart of the drive voltage pulse wave generated to achieve the operation shown in FIG. 7;

FIGS. 13A and 13B illustrate the problems of an inkjet head drive method according to the related art.

DETAILED DESCRIPTION

Preferred embodiments of a drive method for an electrostatic inkjet head according to the present invention, a driver device employing this drive method, and an inkjet printer that uses the electrostatic inkjet head driver according to our invention, are described next below with reference to the accompanying figures.

Electrostatic Inkjet Head

Figure 1:
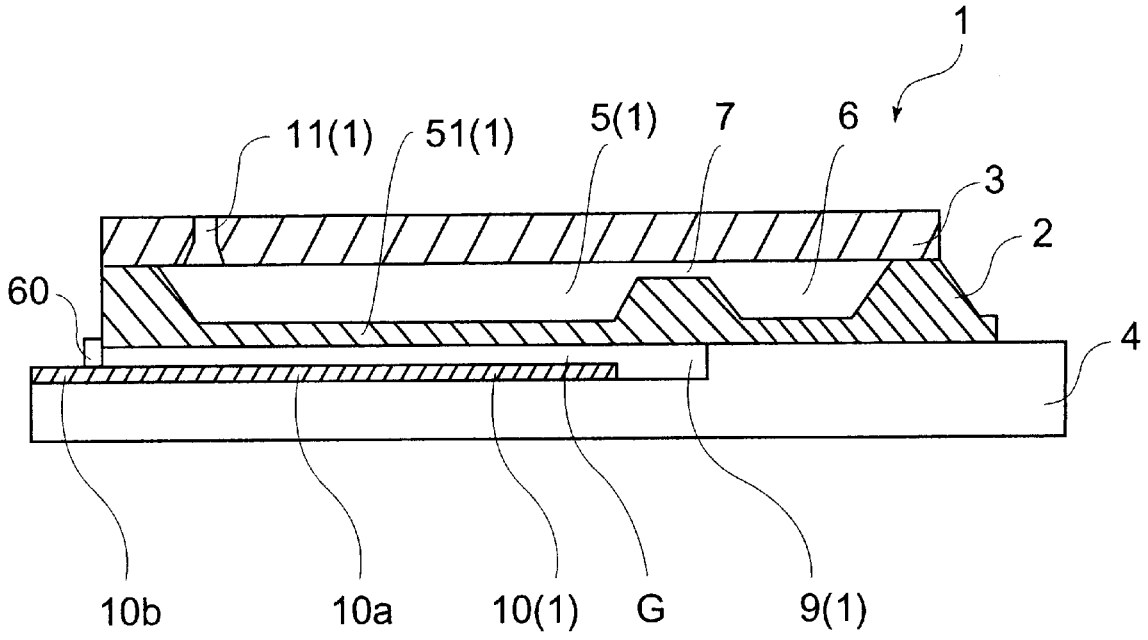
FIG. 1 is a side sectional view (along the line I—I in FIG. 2) of an electrostatic inkjet head in which the present invention is used.
Figure 2:
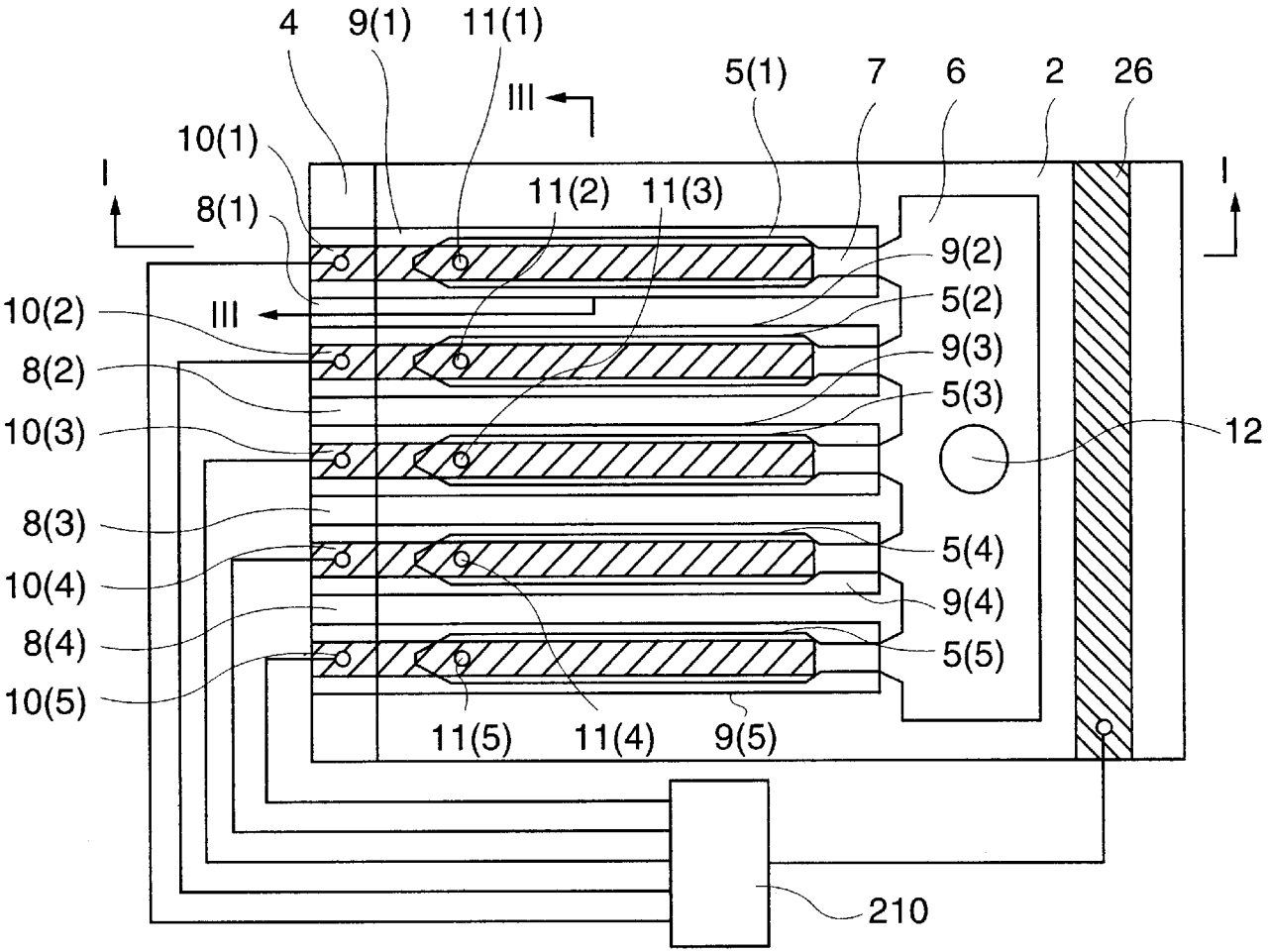
FIG. 2 is a plan view of the electrostatic inkjet head shown in FIG. 1.
Figure 3:
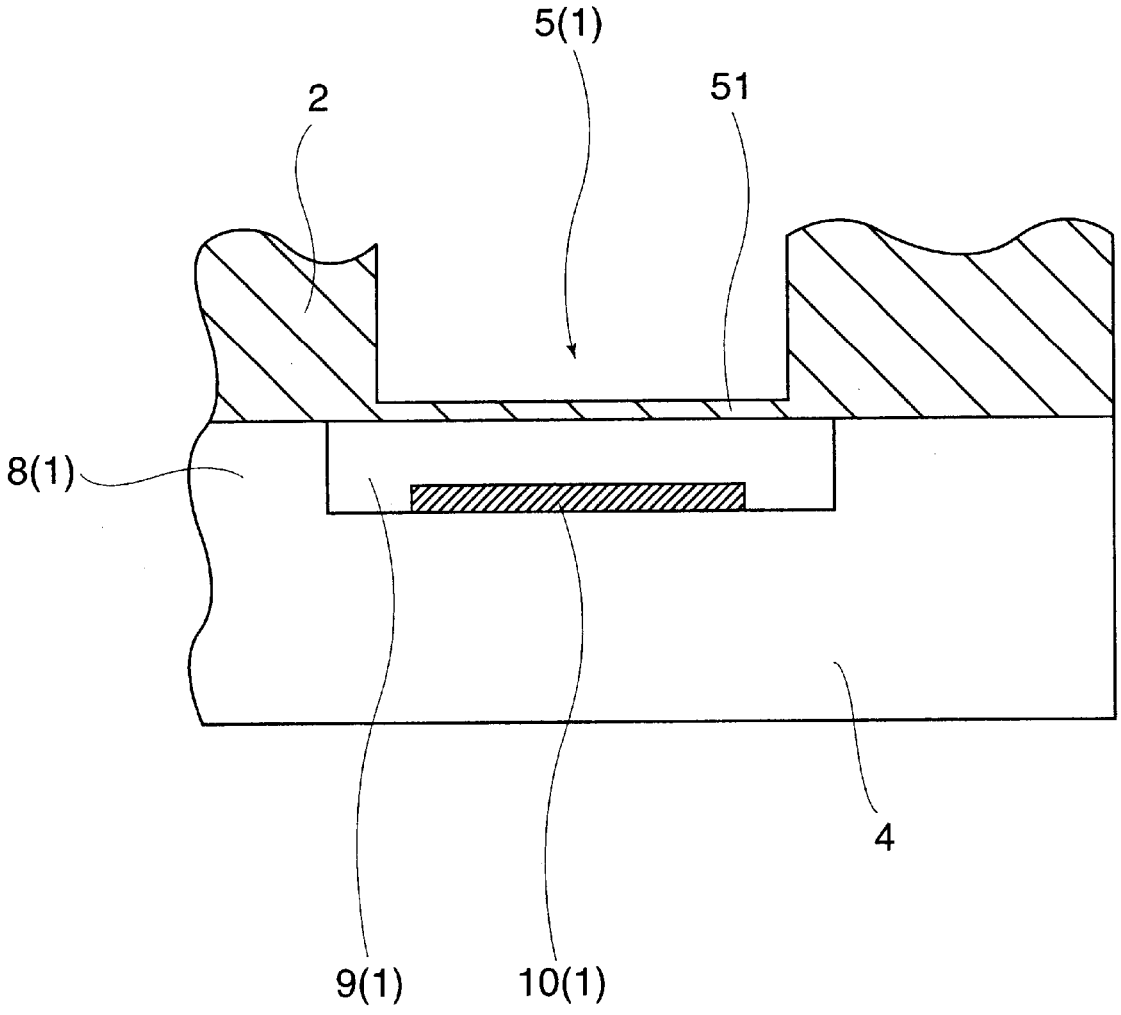
FIG. 3 is an end sectional view (along the line III—III of FIG. 2) of the electrostatic inkjet head shown in FIG. 1.

The configuration of an electrostatic inkjet head suitable for application of the drive method according to the present invention is described first with reference to FIG. 1 to FIG. 3. FIG. 1 is a side sectional view of an electrostatic inkjet head in this example, FIG. 2 is a plan view of the same, and FIG. 3 is an end sectional view.

As shown in these figures, an electrostatic inkjet head 1 according to this preferred embodiment of our invention is a three layer structure in which a silicon layer 2 is disposed between a top nozzle plate 3 made of the same silicon, and a bottom borosilicate glass layer 4 having a thermal expansion coefficient near that of silicon.

Channels are formed in the middle silicon layer 2 by anistropic etching the crystal face surface thereof with KOH (solution). These channels function as five independent, long, slender ink pressure chambers 5(1) to 5(5), one common ink chamber 6, and ink supply openings 7 linking the common ink chamber 6 with each of the ink pressure chambers 5(1) to 5(5). These channels are covered by the nozzle plate 3, thus dividing and forming the parts 5, 6, and 7. Each of the ink pressure chambers 5(1) to 5(5) is separated from one another by respective partitioning walls 8(1) to 8(4).

To communicate with ink supply opening 7, an ink intake opening 12 is further formed in a part defining the bottom of the common ink chamber 6. Ink is thus supplied from an external ink tank (not shown in the figure) through ink intake opening 12 to common ink chamber 6, and is then supplied from chamber 6 through each ink supply opening 7 to each independent ink pressure chamber 5(1) to 5(5).

Ink nozzles 11(1) to 11(5) are formed in the nozzle plate 3 at a position corresponding to the front end part of each respective ink pressure chamber 5(1) to 5(5), that is, at an end position opposite the ink supply opening 7 end, and these communicate with corresponding ink pressure chambers 5(1) to 5(5).

A bottom wall part of each independent ink pressure chamber 5(1) to 5(5) is thin and functions as a diaphragm 51(1) to 51(5) that is flexibly displaceable in the exterior direction, that is, up and down as seen in FIG. 1 (wherein only diaphragm 51(1) is shown).

Next, shallowly etched recesses 9(1) to 9(5) are formed in the top surface of glass layer 4, which is bonded to silicon layer 2. These recess 9(1) to 9(5) are positioned opposite to corresponding diaphragms 51(1) to 51(5), which form the bottom of each ink pressure chamber 5(1) to 5(5) in the silicon layer 2. An individual electrode 10(1) to 10(5) corresponding respectively to diaphragm 51(1) to 51(5) is formed in the bottom of each recess 9(1) to 9(5). Each individual electrode 10(1) to 10(5) has an ITO electrode segment 10*a* and terminal part 10*b*.

By bonding glass layer 4 to silicon layer 2, the diaphragm 51(1) to 51(5) defining the bottom of each ink pressure chamber 5 opposes the electrode segment 10*a* of the corresponding individual electrode with an extremely narrow gap therebetween. This gap G is sealed by a sealant 60 disposed between silicon layer 2 and glass layer 4, and is thus tight.

A common electrode terminal 26 is formed on silicon layer 2 by depositing a platinum or other precious metal thin film on the surface of the nozzle plate 3. A drive voltage pulse is applied by drive control circuit 210 between the common electrode terminal and each individual electrode 10(1) to 10(5). Because the silicon layer 2 is conductive, each diaphragm 51(1) to 51(5) functions as a common electrode.

When a diaphragm 51(1) to 51(5) is attracted toward the individual electrode side by the electrostatic force produced when a drive voltage is applied between diaphragm 51(1) to 51(5) and individual electrode 10(1) to 10(5), diaphragm 51(1) to 51(5) flexibly displaces and bends toward electrode segment 10*a*, contacting the surface of said electrode segment 10*a*. As a result, the capacity of ink pressure chamber 5(1) to 5(5) increases, and ink is supplied from ink supply opening 7 to ink pressure chamber 5(1) to 5(5). Note that only the diaphragm opposite an electrode that is applied with a drive voltage is flexibly displaced. For example, if a drive voltage is applied to only electrodes 10(1) and 10(3), then only corresponding diaphragms 51(1) and 51(3) will be displaced.

When the electrostatic attraction force is cancelled, the diaphragm 51(1) to 51(5) separates from the surface of electrode segment 10*a* and is returned to its initial position by the inherent elasticity of the diaphragm. This quickly reduces the internal volume of the ink pressure chamber 5(1) to 5(5). Part of the ink inside the ink pressure chamber is thus discharged as an ink drop from the ink nozzle 11 communicating with the ink pressure chamber 5(1) to 5(5).

The gap G between an individual electrode and corresponding diaphragm is from approximately 1400 to 1900 angstroms in an inkjet head with an ink nozzle density equivalent to 180 dpi to 360 dpi output. The electrical air gap of this gap G is approximately 1700 to 2200 angstroms when the oxidation film thickness is also considered.

It should be noted here that while this embodiment has been described using a face eject type inkjet head in which ink drops are discharged from nozzle holes formed in the top of nozzle plate 3, it will be obvious to one with ordinary knowledge of the related art that our invention can also be used with an edge eject type inkjet head in which ink drops are discharged from nozzle holes formed in the edge of the nozzle plate.

Drive Method

Figure 4A:
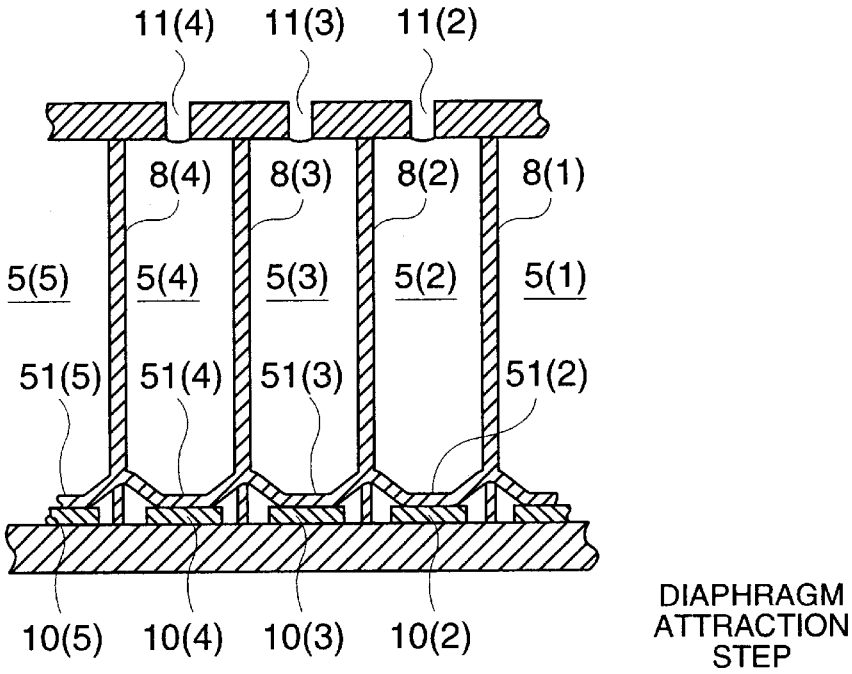
FIGS. 4A and 4B illustrate the operation of the electrostatic inkjet head shown in FIG. 1.
Figure 4B:
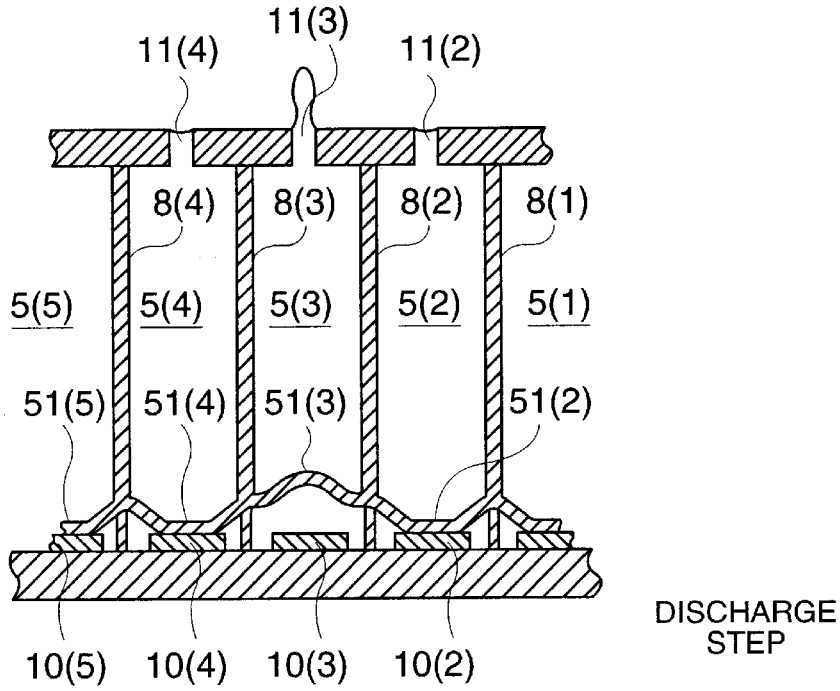
Figure 5:
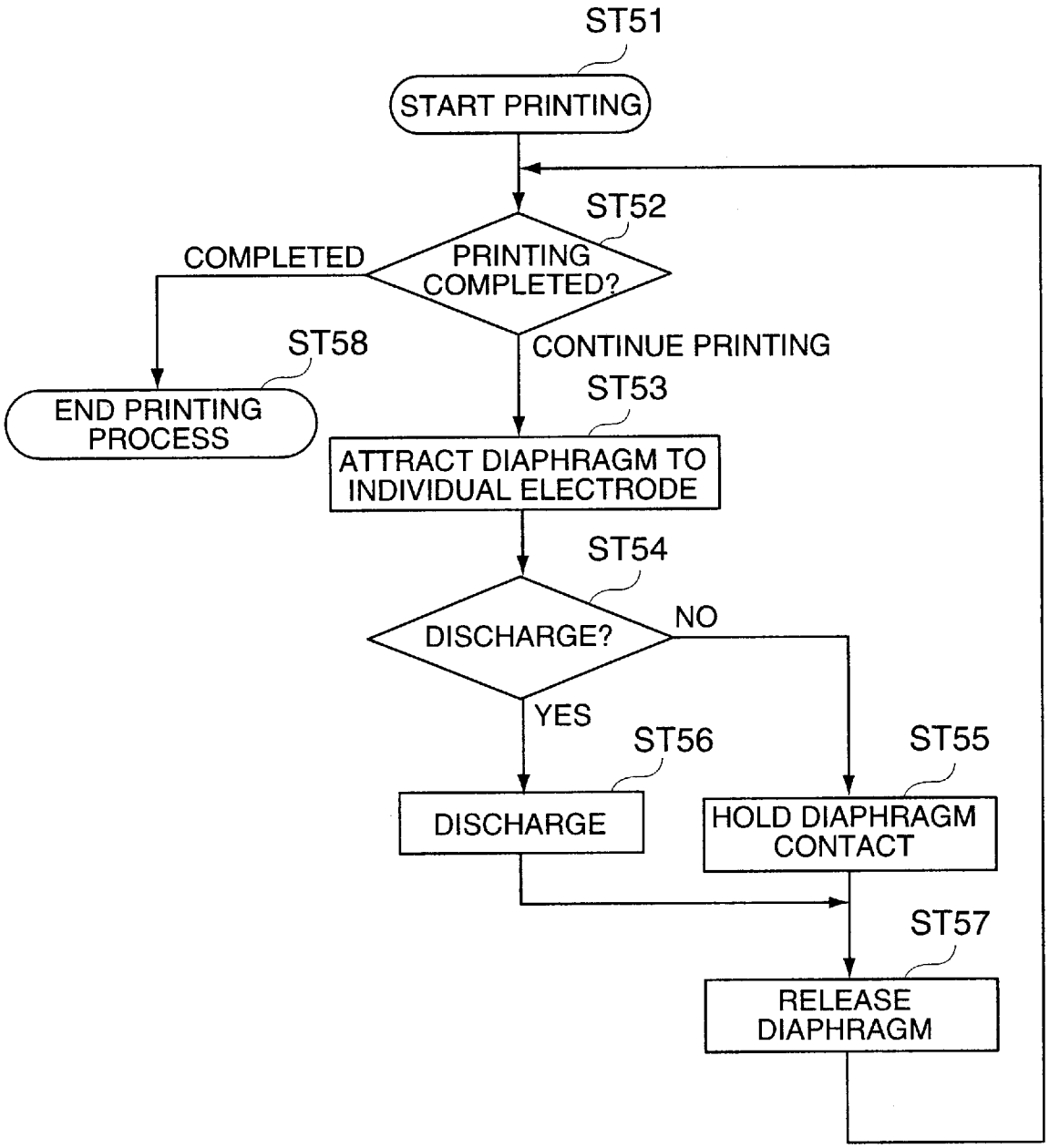
FIG. 5 is a flow chart showing the operation of the electrostatic inkjet head shown in FIG. 1.

FIGS. 4A and 4B are used below to illustrate the drive method of an electrostatic inkjet head 1 according to this embodiment, and FIG. 5 shows a flow chart of this drive method. Our drive method for an electrostatic inkjet head 1 is described next below with reference to these figures.

Referring first to FIG. 4A, it is assumed here that the ink nozzle from which an ink drop is discharged (called the ink discharge nozzle below) is ink nozzle 11(3). In addition, the ink nozzles 11(2) and 11(4) on adjacent sides of the discharge nozzle 11(3) are ink nozzles from which ink drops are not discharged (called non-discharge nozzles below).

When print data is received and printing starts (step ST51 in FIG. 5), a drive voltage pulse is applied between diaphragms 51(2) to 51(4) and corresponding individual electrodes 10(2) to 10(4) in each ink nozzle 11(2) to 11(4). This causes simultaneous attraction of each diaphragm 51(2) to 51(4) to the corresponding individual electrode 10(2) to 10(4). As a result, contact is made at each diaphragm 51(2) to 51(4) as shown in FIG. 4A (step ST53 in FIG. 5, first and second diaphragm attraction step).

Next, with diaphragms 51(2), 51(4) of non-discharge ink nozzles 11(2), 11(4) held in contact individual electrode 10(2), 10(4) (steps ST54, ST55 in FIG. 5, second diaphragm attract and hold step), the diaphragm 51(3) of ink discharge nozzle 11(3) is caused to quickly separate from individual electrode 11(3). As a result, as shown in FIG. 4B, diaphragm 51(3) elastically returns, the capacity of ink pressure chamber 5(3) rapidly decreases, and an ink drop is discharged from ink discharge nozzle 11(3) (ST54, ST56: ink discharge process).

Diaphragms 51(2), 51(4) of non-discharge nozzles 11(2), 11(4) are then separated from individual electrodes 10(2) and 10(4) (step ST57: diaphragm release step). These diaphragms are released and separate from the individual electrodes at a speed slow enough to prevent ink drop discharge from non-discharge nozzles 11(2) and 11(4). One ink drop discharge operation is thus completed by the above described process. This ink drop ink discharge operation is repeated as many times as needed to print the print data, and the printing operation then ends (steps ST52, ST58 in FIG. 5).

An exemplary drive voltage pulse waveform applied between the diaphragm, i.e., common electrode, and individual electrode to achieve the above described operation is shown in FIG. 6. A drive voltage pulse such as shown is generated by drive voltage applying circuit or means 210 shown in FIG. 2, and more specifically by head driver IC 109 of the driver device 100 described in further detail below (see FIG. 9).

Figures 6A, 6B, 6C, 6D, 6E, 6F:
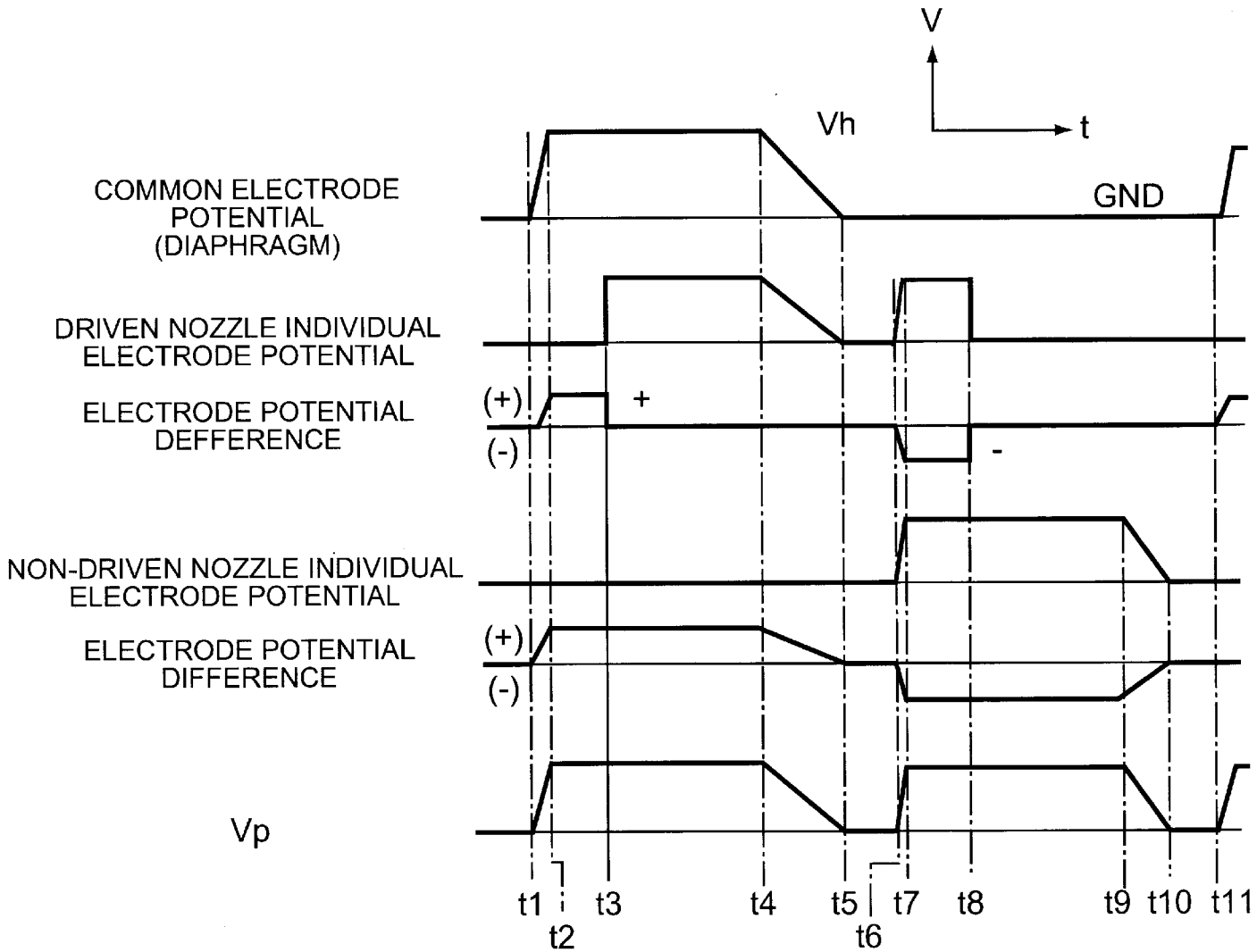
FIGS. 6A to 6F illustrate a timing chart of the drive voltage pulse wave generated to achieve the operation shown in FIGS. 4A and B.

The basic voltage pulse wave of drive voltage Vp is shown first in FIG. 6F. A discharge operation for one ink drop occurs at each one pulse of this basic voltage wave. For example, the intervals between time t1 and t6, and between t6 and t11, each represent one discharge cycle. These first and second discharge cycles are repeatedly performed. This basic voltage waveform pulse has a sharp rising edge (from time t1 to t2) and a falling edge (from time t4 to t5) with a gradual slope.

Using the three ink nozzles 11(2) to 11(4) shown in FIGS. 4A and B by way of example, the voltage applied to the diaphragms 51(2) to 51(4), functioning as a common electrode, has a voltage pulse of the same shape as the basic voltage wave in the first discharge cycle from time t1 to t6 as shown in FIG. 6A. It is held at the ground potential GND in the second discharge cycle, i.e., from time t6 to t11.

As shown in FIG. 6B, the individual electrode potential of discharge nozzle 11(3), that is, the potential of individual electrode 10(3), is held at the ground potential from time t1 to time t3 in the first discharge cycle, then rises suddenly to the common electrode potential at time t3, and is then held at the same potential as the common electrode potential until time t6. In the second discharge cycle, the potential rises sharply at time t6, is held at a high potential until time t8, then falls sharply to the ground potential, and is thereafter held at the ground potential until time t11.

As a result, the potential difference between diaphragm 51(3) and individual electrode 10(3) of discharge nozzle 11(3) is held at a positive potential difference from time t1 to t3 in the first discharge cycle as shown in FIG. 6C, and is conversely held at a negative potential difference from time t6 to t8 in the second discharge cycle. During these periods of potential difference, an attraction force is generated that pulls the diaphragm 51(3) toward the individual electrode 10(3). At times other than these, there is no potential difference and no attraction force is generated.

Therefore, in the first discharge cycle diaphragm 51(3) is attracted quickly toward individual electrode 10(3) from time t1 and is held in contact therewith (the first diaphragm attraction step), and at time t3 diaphragm 51(3) separates rapidly from individual electrode 10(3) and elastically returns to the initial position (ink discharge step). By means of this diaphragm movement, an ink drop is discharged from discharge nozzle 11(3) at a specific point in time after time t3. Likewise, in the second discharge cycle, diaphragm 51(3) is attracted quickly toward individual electrode 10(3) from time t6 and is held in contact therewith (first diaphragm attraction step), and at time t8 diaphragm 51(3) separates rapidly from individual electrode 10(3) and elastically returns (ink discharge step). By means of this diaphragm movement, an ink drop is discharged from discharge nozzle 11(3) at a specific point in time after time t8.

It should be noted that the polarity of the potential difference between the individual electrode and common electrode is reversed from the first discharge cycle to the second discharge cycle because, if the polarity of the potential difference is always the same a charge could be stored between the electrodes, thereby making it impossible to achieve the desired force of electrostatic attraction.

In contrast with the above, the individual electrode potential of the non-discharge nozzle 11(2), adjacent to the discharge nozzle 11(3), is held at the ground potential, as shown in FIG. 6D, in the first discharge cycle, and at the same potential state as the basic drive voltage pulse wave in the second discharge cycle. That is, it is held in the reverse to the potential state of the diaphragm 51(2), i.e., the common electrode, in the first and second discharge cycles.

As a result, the potential difference of the diaphragm 51(2) and individual electrode 10(2) of the non-discharge nozzle 11(2) resembles the basic voltage wave in the first discharge cycle and the second discharge cycle as shown in FIG. 6E.

Therefore, diaphragm 51(2) is attracted from time t1 in the first discharge cycle to individual electrode 10(2), and is held in contact therewith until time t4 (second diaphragm attraction step). Then, the potential difference gradually decreases. That is, the charge between the common and individual electrodes is gradually discharged. As a result, separation of diaphragm 51(2) begins between time t4 and time t5, and it returns elastically (separation step) at a speed slower than during attraction. Likewise, diaphragm 51(2) is attracted to individual electrode 10(2) from time t6 in the second discharge cycle (second diaphragm attraction step), and is held in contact therewith until time t9 (second diaphragm attract and hold step). The potential difference then gradually decreases. That is, the charge between the electrodes is gradually discharged. As a result, separation of diaphragm 51(2) begins between time t9 and time t10, and it returns elastically (separation step) at a speed slower than during attraction.

Attraction of diaphragm 51(2) on the non-discharge nozzle 11(2) side thus occurs in synchronism with attraction of diaphragm 51(3) on the discharge nozzle 11(3), and, as shown in FIG. 4A, the diaphragm contacts the individual electrode in each of the nozzles. Next, an ink drop is discharged from discharge nozzle 11(3) while this contact state is held for diaphragm 51(2). Then, the diaphragm 51(2) of the non-discharge nozzle 11(2) separates from the individual electrode 10(2) and returns gradually to the original position. By adjusting the speed at which this diaphragm elastically returns, ink drop discharge from the non-discharge nozzle 11(2) can be completely prevented when the diaphragm 51(2) elastically returns. It should be noted that non-discharge nozzle 11(4) operates identically to non-discharge nozzle 11(2).

Some specific values for the rate of diaphragm return are provided for reference. In a typical inkjet head with a nozzle density equivalent to 180 or 360 dpi, the gap G between the diaphragm and individual electrode is between approximately 1400 and 1900 angstroms in current inkjet head designs. If we assume this gap G to be the typical 1750 angstroms, approximately 1 $\mu$s is required for the diaphragm to return, and the average rate of diaphragm return is approximately 0.175 m/s. The field strength produced between the diaphragm and individual electrode during first and second diaphragm attraction and separation is approximately 1.1 to 1.3 MV/cm, and the field strength when each diaphragm is held to the individual electrode is approximately 2.2 to 3.3 MV/cm.

In an electrostatic inkjet head drive method according to this embodiment as described above, high rigidity is maintained by attracting and holding the diaphragms 51(2), 51(4) of the non-discharge nozzles 11(2), 11(4), adjacent to the discharge nozzle 11(3), to the corresponding individual electrodes 10(2), 10(4). As a result, low compliance can be achieved in the ink pressure chambers 5(2), 5(4) of the non-discharge nozzles.

Therefore, the partitioning walls 8(2), 8(4) separating the ink pressure chamber 5(3), on the low compliance discharge nozzle side, from the ink pressure chamber 5(2), 5(4), on the likewise low compliance non-discharge nozzle side, can be prevented or suppressed from bending as a result of pressure change in the ink pressure chamber on the discharge nozzle side.

Therefore, because pressure crosstalk between ink pressure chambers can be prevented or suppressed regardless of whether adjacent ink nozzles are driven, deterioration of ink discharge characteristics in each ink nozzle due to such bending can be prevented or suppressed even in a high density inkjet head in which the partitioning walls are thin. It is therefore possible to easily assure high resolution, precise print quality by using the drive method of this embodiment.

Alternative Embodiment of an Inkjet Head Drive Method

It will be evident to one with ordinary skill in the related art that the drive voltage waveform shown in FIG. 6 is simply exemplary of a waveform that can be used to achieve the drive method of our invention, and other drive methods can be alternatively used.

For example, diaphragms 51(2) to 51(4) for both discharge and non-discharge nozzles are released from the individual electrodes 10(2) to 10(4) in the above noted drive method during one ink discharge. It is alternatively possible, however, to keep diaphragms 51(2) to 51(4) in contact with the corresponding individual electrode 10(2) to 10(4) until all print data has been printed, and flexibly displacing and releasing only the diaphragm of the discharge nozzle from the individual electrode during ink drop discharge, and then restoring the diaphragm to contact with the individual electrode after ink discharge.

Figure 7:
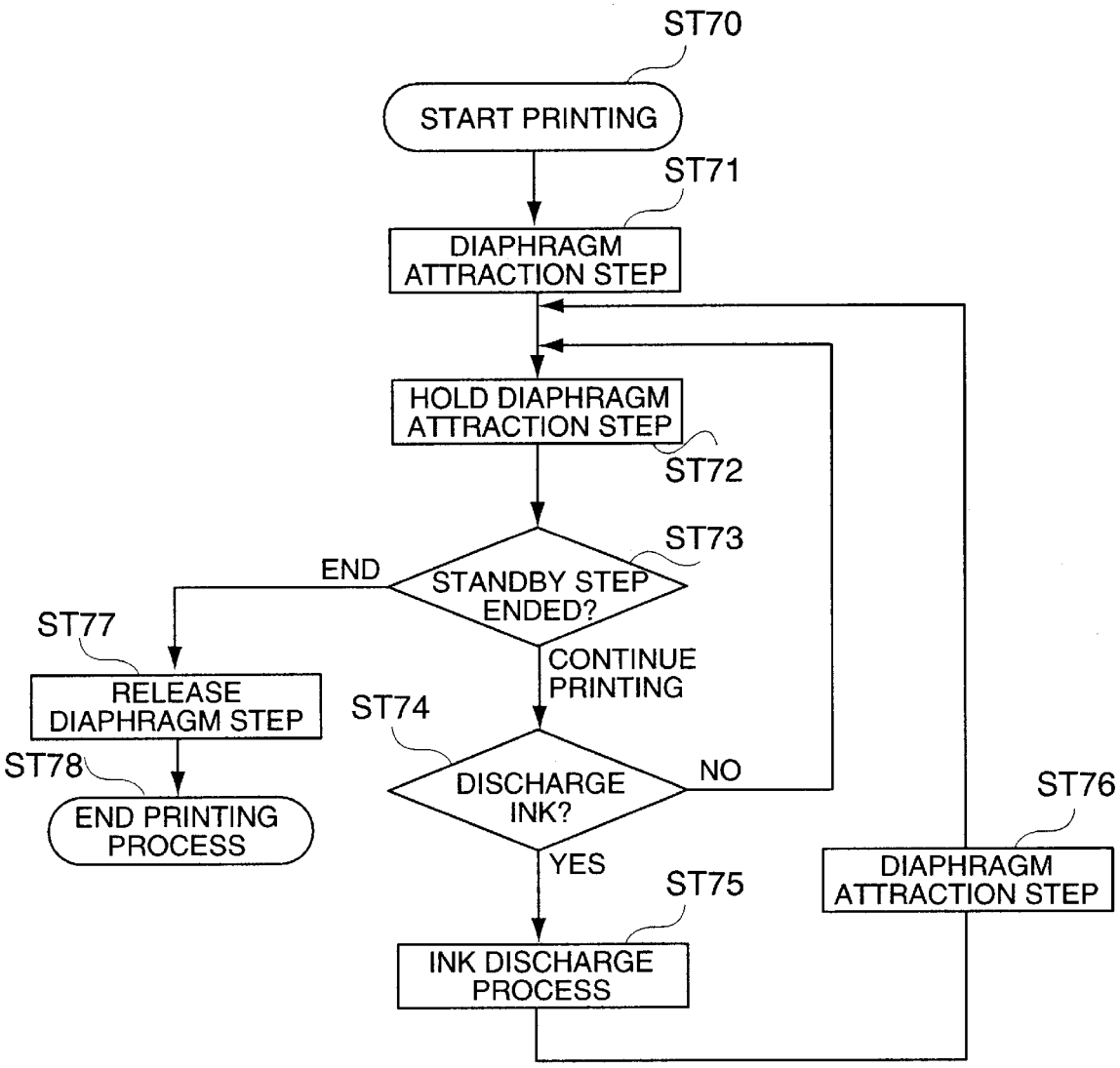
FIG. 7 is a flow chart of an alternative electrostatic inkjet head drive method according to the present invention.

FIG. 7 is typical flow chart of this drive method. The electrostatic inkjet head 1 drive method according to this preferred embodiment of the invention is described next below with reference to FIGS. 4A and B and FIG. 7. It is assumed here, too, that the ink nozzle from which an ink drop is discharged (called the ink discharge nozzle below) is ink nozzle 11(3). In addition, the ink nozzles 11(2) and 11(4) on adjacent sides of the discharge nozzle 11(3) are ink nozzles from which ink drops are not discharged (called non-discharge nozzles below).

When print data is received and printing starts (step ST70 in FIG. 7), voltage is applied between diaphragms 51(2) to 51(4) and corresponding individual electrodes 10(2) to 10(4) in each ink nozzle 11(2) and 11(4) to produce a potential difference, and simultaneously attracting each diaphragm 51(2) to 51(4) to the corresponding individual electrode 10(2) to 10(4) and hold in contact thereto (step S71 in FIG. 7: first and second diaphragm attraction step). By then maintaining this potential difference between diaphragm 51(2) to 51(4) and corresponding individual electrode 10(2) to 10(4), the respective diaphragms are held in contact with the individual electrodes (step ST72 in FIG. 7: attract and hold step).

It should be noted that the voltage applied between diaphragm 51(2) to 51(4) and corresponding individual electrode 10(2) to 10(4) to maintain contact therebetween can be lower than the voltage applied to initially attract the diaphragm to the individual electrode. This is because the electrostatic force is high even if the voltage required to maintain contact is low once contact is established.

Next, contact between diaphragms 51(2) and 51(4) and individual electrodes 10(2) and 10(4) is maintained for non-discharge nozzles 11(2) and 11(4) (steps ST74, ST72 in FIG. 7: hold contact step). The diaphragm 51(3) of the discharge nozzle 11(3), however, is quickly released from the individual electrode 10(3). This is accomplished by applying a specific drive voltage to the individual electrode 10(3) to achieve the same potential as the diaphragm 51(3), and the charge between the electrodes is then quickly discharged. This allows diaphragm 51(3) to return as shown in FIG. 4B due to its inherent elasticity, thus rapidly reducing the capacity of ink pressure chamber 5(3) and discharging an ink drop from the discharge nozzle 11(3) (step ST75, FIG. 7: discharge step).

After thus discharging an ink drop from discharge nozzle 11(3), the diaphragm 51(3) is again attracted to individual electrode 10(3) and contact therebetween is maintained (step S76, restore attraction of first diaphragm, and step S72). The contact state shown in FIG. 4A is thus re-established.

The above noted steps complete the discharge operation for a single ink drop. To discharge more ink drops, this process is simply repeated the appropriate number of times. After ink discharge that completes the printing operation, the diaphragms 51(2) to 51(4) are released from the corresponding individual electrodes 10(2) to 10(4) of each ink nozzle 11(2) to 11(4) (steps ST73 and ST77, diaphragm release). The speed at which the diaphragms are released is slower than that used to discharge ink drops from the ink nozzles 11(2) to 11(4). This completes the printing operation for the received print data (step ST78 of FIG. 7).

FIGS. 8A to 8I form a waveform diagram of the drive voltage pulse wave applied between the individual electrodes and diaphragms (i.e. common electrode) to achieve the above operation. This drive voltage pulse is generated by the driver (driver circuit or drive voltage applying means) 210 shown in FIG. 2, or more specifically by the head driver IC 109 of the drive control circuit 100 shown in FIG. 9.

Referring to FIGS. 8A to 8I, a complete printing sequence is accomplished in the interval from time t1 to time t7. Two ink drops are discharged during this period in the present example. The following period from time t8 to t10 is the period in which potential inversion control unaccompanied by ink drop discharge is applied. This potential inversion control is further described below.

The basic voltage pulse wave Vp of the drive voltage is shown first in FIG. 8B. One ink drop is discharged at each pulse of this basic voltage pulse wave Vp. For example, the intervals between time t2 and t4, and between t4 and t6, are each one discharge cycle. One ink drop is discharged from the ink nozzle due to the sharp change in the basic voltage pulse wave Vp at time t3 and time t5. These first and second discharge cycles are performed repeatedly. This basic voltage waveform pulse Vp has a sharp rising edge (the change in voltage to voltage Vh beginning from time t3 and t5) and a falling edge (change to ground potential GND beginning from time t4 and t6) with a slope that is more gradual than the rising edge.

Voltage Vh shown in FIG. 8A is the supply potential of a high withstand voltage channel. The slope of the rise in Vh at t1 and the fall at t7 is the same, and is gradual so that an ink drop will not be discharged due to a change in the potential difference between supply potential Vh and ground potential GND occurring between the diaphragm and individual electrode.

Using the three ink nozzles 11(2) and 11(4) shown in FIGS. 4A and 4B by way of example, the voltage applied to the diaphragms 51(2) to 51(4) functioning as the common electrode has the same waveform as the supply potential Vh of a high withstand voltage channel from t1 to t7 as shown in FIG. 8C. Diaphragms 51(2) to 51(4) are held in contact with individual electrodes 10(2) to 10(4) from time t2 in a standby state. Ground potential GND is then applied from t8 to t10 during which potential inversion control is applied.

As shown in FIG. 8D, the individual electrode potential of discharge nozzle 11(3), that is, the potential of diaphragm 51(3), has the same shape as basic voltage pulse wave Vp during the discharge cycle from t1 to t7. In the first discharge cycle the individual electrode potential rises sharply to supply potential Vh (the common electrode potential) at t3, and is then held at the common electrode potential to t4. After t4, the individual electrode potential is again held at the ground potential GND. In the second discharge cycle the potential rises sharply again at t5, is held at this high potential to t6, and thereafter is again held at the ground potential GND.

The potential difference between the diaphragm 51(3) and individual electrode 10(3) of the discharge nozzle 11(3) is thus held at a positive potential difference when contact is held between the diaphragm and individual electrode between t2 and t3 as shown in FIG. 8E, and a zero potential difference is held between t3 and t4 in the first discharge cycle and t5 and t6 in the second discharge cycle. In other words, a static charge attracting the diaphragm to the individual electrode is not produced. The positive potential difference held at other times produces a static charge pulling the diaphragm to the individual electrode so that the diaphragm is held in contact with the individual electrode.

As a result, in the first discharge cycle diaphragm 51(3) is quickly released from the individual electrode 10(3) at t3 and thus returns, causing an ink drop to be discharged from the discharge nozzle 11(3) at a specific time after t3. Then at time t4 the diaphragm 51(3) is pulled to individual electrode 10(3) again, and the diaphragm-individual electrode contact state (standby state) is restored. Likewise in the second discharge cycle diaphragm 51(3) is quickly released from the individual electrode 10(3) at t5 and thus returns, causing an ink drop to be discharged from the discharge nozzle 11(3) at a specific time after t5. Then at time t6 the diaphragm 51(3) is pulled to individual electrode 10(3) again, and the diaphragm-individual electrode contact state (standby state) is again restored.

In contrast with the above operation of the discharge nozzle, the individual electrode potential is held at the ground potential as shown in FIG. 8F throughout the first and second discharge cycles in non-discharge nozzle 11(2) adjacent to discharge nozzle 11(3).

The potential difference state of diaphragm 51(2) and individual electrode 10(2) of the non-discharge nozzle 11(2) in the first and second discharge cycles is thus similar to the supply potential Vh of the high withstand voltage channel as shown in FIG. 8G.

Therefore, diaphragm 51(2) is pulled to individual electrode 10(2) at t1 in the first discharge cycle and contact is held to t7.

When the standby state ends, the potential difference is gradually reduced from t7. More specifically, the charge between the electrodes is gradually discharged. This means that release of diaphragms 51(2) to 51(4) begins and the diaphragms gradually return to the normal position at a slower rate than that used for ink drop discharge between the point where the potential difference starts declining at t7 and finally dissipates completely.

The displacement of diaphragm 51(3) of discharge nozzle 11(3) at each point in the above control process is shown in FIG. 8H. The displacement of diaphragms 51(2) and 51(4) of non-discharge nozzles 11(2) and 11(4) at the same points in time is shown in FIG. 8I. Diaphragm displacement is shown in the vertical direction in these charts where G indicates the gap between diaphragm 51 and individual electrode 10 when a field is not applied between the electrodes. A decrease in the gap between diaphragm 51 and individual electrode 10 is shown as a (−) change, and an increase as a (+) change.

The position of discharge nozzle diaphragm 51(3) (FIG. 8H) at each point in time is described next below with reference to the steps in the flow chart in FIG. 7. For reference, the time required at each step in the case of a typical electrostatic inkjet head is shown in parentheses.

t1 to t2 (approx. 2 μs to 1 ms): diaphragm 51(3) of discharge nozzle 11(3) is pulled to individual electrode 10(3) from t1 to t2 (ST71, first diaphragm attraction step).

t2 to t3 (approx. 40 μs or more): after diaphragm 51(3) contacts individual electrode 10(3), contact therebetween is held to t3 (ST72, hold contact with first diaphragm).

t3 to t4 (time from t3 to actual ink drop discharge, approx. 30 to 125 μs; time from ink drop discharge to t4, approx. 10 μs): diaphragm 51(3) is rapidly released at t3 and returns, thus pressurizing the ink in ink pressure chamber 5(3), and discharging an ink drop from discharge nozzle 11(3) at time h1 (ST74, ink drop discharge). Diaphragm 51(3) then vibrates, and at a point substantially synchronized to the vibration cycle of diaphragm 51(3), that is, when diaphragm displacement heads in the (−) direction, potential is applied to individual electrode 10(3) to produce a desired potential difference between the electrodes again, thereby pulling the diaphragm to the individual electrode 10(3) again at t4 (ST76, restore first diaphragm-individual electrode contact).

t4 to t5 (approx. 2 to 25 μs): in preparation for the next ink drop discharge at t5, contact between diaphragm 51(3) and individual electrode 10(3) is held to t5 (ST72, hold contact with first diaphragm).

t5 to t7 (time from t5 to actual ink drop discharge, approx. 30 to 125 μs; time from ink drop discharge to t6, approx. 10 μs; time from t6 to t7, approx. 2 to 25 μs): diaphragm 51(3) is again driven to discharge an ink drop at time h2 by repeating the same cycle described above from t5 to t7 for the desired discharge nozzle 11(3). If necessary, the cycle from t5 to t7 is repeated two or more times to complete printing.

t7 to t8 (time required for the diaphragm to be released from the individual electrode at t7 and return to its normal neutral state: approx. 0.2 ms to 1 ms): diaphragm 51(3) of the discharge nozzle 11(3) gradually separates from individual electrode 10(3) at t7 to complete the print control cycle. Note that ink is not discharged from discharge nozzle 11(3) at this time (ST77, diaphragm release).

Next, as shown in FIG. 8I, diaphragms 51(2) and 51(4) of non-discharge nozzles 11(2) and 11(4) are pulled to individual electrodes 10(2) and 10(4) from t1 to t2 (ST71, first diaphragm attraction step). Contact between these electrodes is then held to t7 (ST72, hold diaphragm contact).

Because no ink is discharged from non-discharge nozzles 11(2) and 11(4), diaphragms 51(2) and 51(4) are held in contact with the individual electrodes 10(2) and 10(4) even when discharge nozzle 11(3) is driven to discharge ink, and compliance in the ink paths to these ink pressure chambers 5(2) and 5(4) is therefore low. Because ink path compliance is low while the diaphragms are held to the electrodes, partitioning walls 8(1) to 8(4) will not be deflected, and there will be no pressure loss in the ink pressure chamber 5(3) of discharge nozzle 11(3) when discharge nozzle 11(3) is driven to discharge. As a result, there will be no discrepancy between the expected output and the actual output obtained from discharge nozzle 11(3), and stable ink drop discharge can be assured.

At t7, diaphragms 51(2) and 51(4) of non-discharge nozzles 11(2) and 11(4) are released from individual electrodes 10(2) and 10(4) and gradually return, ending the standby state of the print control process. As noted above, no ink is discharged from non-discharge nozzles 11(2) and 11(4) at this time (ST77, diaphragm release).

As described above, diaphragm 51(2) of the non-discharge nozzle 11(2) is held in contact with the corresponding individual electrode throughout the period in which diaphragm 51(3) of the discharge nozzle 11(3) is held in contact with the individual electrode and released to discharge ink, and in the standby period shown in FIG. 4A the diaphragm of each nozzle is held in contact with the corresponding individual electrode. While the non-discharge nozzle diaphragms remain in contact with the corresponding individual electrodes, ink is discharged from discharge nozzle 11(3). When the standby state is then terminated, diaphragm 51(2) of non-discharge nozzle 11(2) is released from individual electrode 10(2) and gradually returns to the neutral position. By thus adjusting the speed at which the diaphragm is released and returns to neutral, ink can be reliably prevented from being discharged from any non-discharge nozzle 11(2) when the diaphragm 51(2) thereof returns to the neutral position.

It should be noted that operation of non-discharge nozzle 11(4) is identical to that of non-discharge nozzle 11(2).

As will be appreciated from the above, an electrostatic inkjet head drive method according to this preferred embodiment of the invention achieves and maintains high rigidity in non-discharge nozzles adjacent to a driven discharge nozzle by pulling diaphragms 51(2) and 51(4) of the non-discharge nozzles 11(2) and 11(4) adjacent to discharge nozzle 11(3) to the individual electrodes 10(2) and 10(4) thereof and maintaining contact between the electrodes throughout the driven nozzle discharge cycle. The effect of this is to make the compliance of the nondischarge nozzle ink pressure chambers 5(2) and 5(4) low.

As a result of the compliance of the discharge nozzle ink pressure chamber 5(3) being low and the compliance of the adjacent non-discharge nozzle ink pressure chambers 5(2) and 5(4) also being low, the partitioning walls 8(2) and 8(4) can be reliably prevented from bending as a result of a change in the pressure in the ink pressure chamber of the discharge nozzle.

It is therefore possible to prevent or suppress pressure crosstalk between ink pressure chambers irrespective of whether adjacent ink nozzles are driven or not driven. When the ink pressure chamber partitioning walls are made thin to achieve a high density inkjet head, a drop in the ink discharge characteristics of the ink nozzles can be reliably prevented or suppressed because the partitioning walls are prevented from bending undesirably. It is therefore possible by using the drive method of our invention to easily assure high resolution and precise print quality.

It should be noted that the polarity of the potential difference between the individual electrode and common electrode is reversed from t8 because if the polarity of the potential difference remains the same charge accumulation between the electrodes can make it impossible to achieve the desired electrostatic force. However, any accumulated charge can be eliminated by reversing the polarity, and consistently stable diaphragm operation can be assured. This control technique is referred to herein as potential inversion control.

More specifically, in an electrostatic inkjet head drive method using electrostatic force to deform a diaphragm and discharge ink drops, potential inversion control is an inkjet head drive control technique for eliminating the effects of any residual charge remaining in the diaphragm, and assuring consistently good ink drop discharge.

This potential inversion control is characterized by deforming the diaphragm and discharging an ink drop from the nozzle during a first drive mode in which voltage of a first polarity is applied between the diaphragm and individual electrode, and eliminating any residual charge accumulated during the first drive mode by applying a voltage of a second polarity, that is, the polarity opposite the first polarity, between the diaphragm and individual electrode during a second drive mode, which is a mode in which ink is not discharged from the same nozzle and occurs at a regular period during the ink drop discharge operation of the first drive mode.

Because the frequency of the first drive mode and second drive mode differ, charge accumulation is still a concern. This concern can be addressed, however, in a printer that uses an inkjet head to vertically scan and print to a print medium by applying potential inversion control according to the above second drive mode during every inkjet head drive pass. In a line inkjet printer that prints by scanning in only the primary scanning direction of the print medium, potential inversion control according to the above second drive mode is applied at every print transaction. This makes it possible to suppress residual charge accumulation in the diaphragm to a practicably insignificant level even though the frequency first drive mode operation and second drive mode operation differ.

The common electrode potential shown in FIG. 8C goes to the ground potential GND after t8 (FIG. 8) during this potential inversion control. The individual electrode potential shown in FIG. 8D and F goes to the same potential as supply potential Vh of the high withstand voltage channel. As a result, the waveform of the potential difference between electrodes shown in FIGS. 6E and G is essentially the inverse of the waveform of the supply potential Vh of the high withstand voltage channel.

This potential inversion control method can be applied to the electrostatic inkjet head drive method of the present invention to stabilize diaphragm operation and assure consistent ink drop discharge performance by treating drive period t1 to t7 as the first drive mode, and period t8 to t10 as the second drive mode of the above noted potential inversion control method.

It should be noted that in the drive method described with reference to FIGS. 8A to I potential inversion control is used to eliminate residual charge and stabilize diaphragm operation. It is also possible, however, to eliminate this residual charge in the electrostatic inkjet head drive method of our invention by using a technique for eliminating from outside the ink nozzle or dispersing into the ink chamber high viscosity ink in the ink path. This technique is accomplished by applying a charge with polarity opposite that of the drive field polarity, and is typically used as part of the electrostatic inkjet head setup process before or after driving the head to discharge ink. Similarly to the above potential inversion control method, this technique can also be applied to all nozzles at the same time.

Driver Device for an Electrostatic Inkjet Head

A driver for an electrostatic inkjet head using the above noted drive method of the present invention is described next below.

Figure 9:
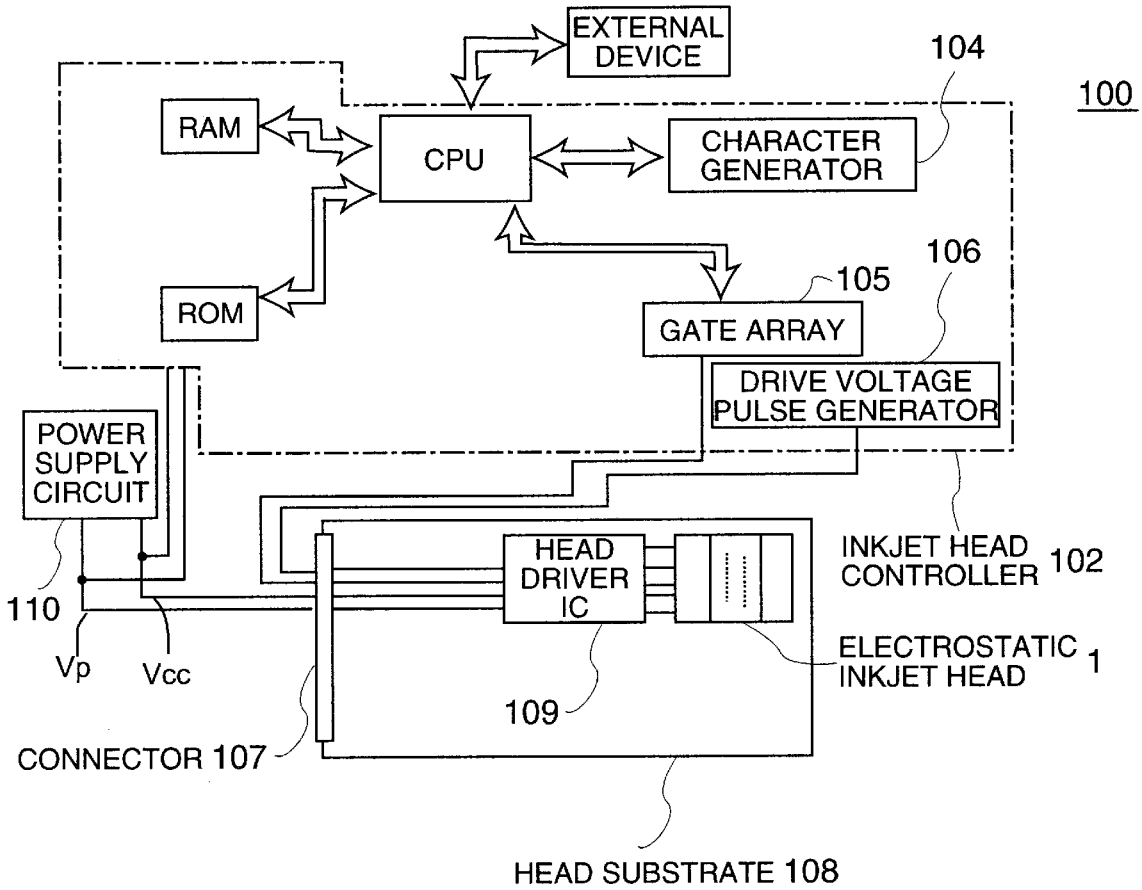
FIG. 9 is a block diagram of an electrostatic inkjet head driver device implementing the method of the present invention.

FIG. 9 is a block diagram of this electrostatic inkjet head driver. The electrostatic inkjet head driven and controlled by the driver device 100 shown in FIG. 9 is identical to the electrostatic inkjet head shown in FIG. 1 to FIG. 3. Like parts are therefore identified by like reference numerals, and further description thereof is omitted below.

This electrostatic inkjet head driver device 100 has an inkjet head controller 102 (control means), which comprises primarily a CPU. Printing information is supplied from external device 103 to the CPU through an intervening bus. ROM, RAM, and character generator 104 are connected to the CPU by way of an internal bus. An area within the RAM is used as working memory for running the control program stored in ROM and generating the inkjet head drive control signal based on character data generated by the character generator 104. Gate array 105 supplies a drive control signal corresponding to the print information to head driver IC 109 based on a control signal from the CPU, and supplies a control signal for generating a drive voltage pulse to the drive voltage pulse generator 106.

When the control signal from the gate array is supplied to drive voltage pulse generator 106 (drive pulse generating means), drive voltage pulse generator 106 generates the drive voltage pulse and supplies drive voltage pulse Vp to head driver IC 109. The drive voltage pulse generator 106 also converts the digital control signal to an analog drive voltage pulse wave by means of a D/A converter. In other words, drive voltage pulse generator 106 generates a drive pulse wave from a control signal relating to the pulse signal conditions, including the drive voltage pulse length, voltage, rise time, and fall time.

By using a D/A converter for drive voltage pulse generator 106, a desired drive voltage pulse wave can be precisely generated by simply increasing the bit rate of the D/A converter to increase the resolution of the waveform. It will also be evident that a CR circuit can be alternatively used for the drive voltage pulse generator 106. In this case the drive voltage pulse generator 106 can be provided at a lower cost than if a D/A converter is used.

The drive control signal and drive voltage pulse are passed through connector 107 to the head driver IC 109 formed in head substrate 108. The head driver IC 109 (switching device or means) operates according to the supply potential Vh of the high withstand voltage channel, and the logic circuit drive voltage Vcc. The head driver IC 109 switches between the drive voltage pulse and ground potential GND based on the supplied drive control signal, and thus applies a particular voltage to opposing electrodes of the ink nozzles in electrostatic inkjet head 1. When the drive voltage pulse is applied between opposing electrodes, the diaphragm 51 in which a potential difference is produced is attracted to the opposing electrode. While this potential difference is maintained between opposing electrodes, diaphragm 51 remains in contact with the opposing individual electrode 10. When the potential difference is suddenly eliminated, producing a sudden change in potential in a particular ink nozzle, the diaphragm 51 thereof vibrates and an ink drop is discharged.

Figure 10:
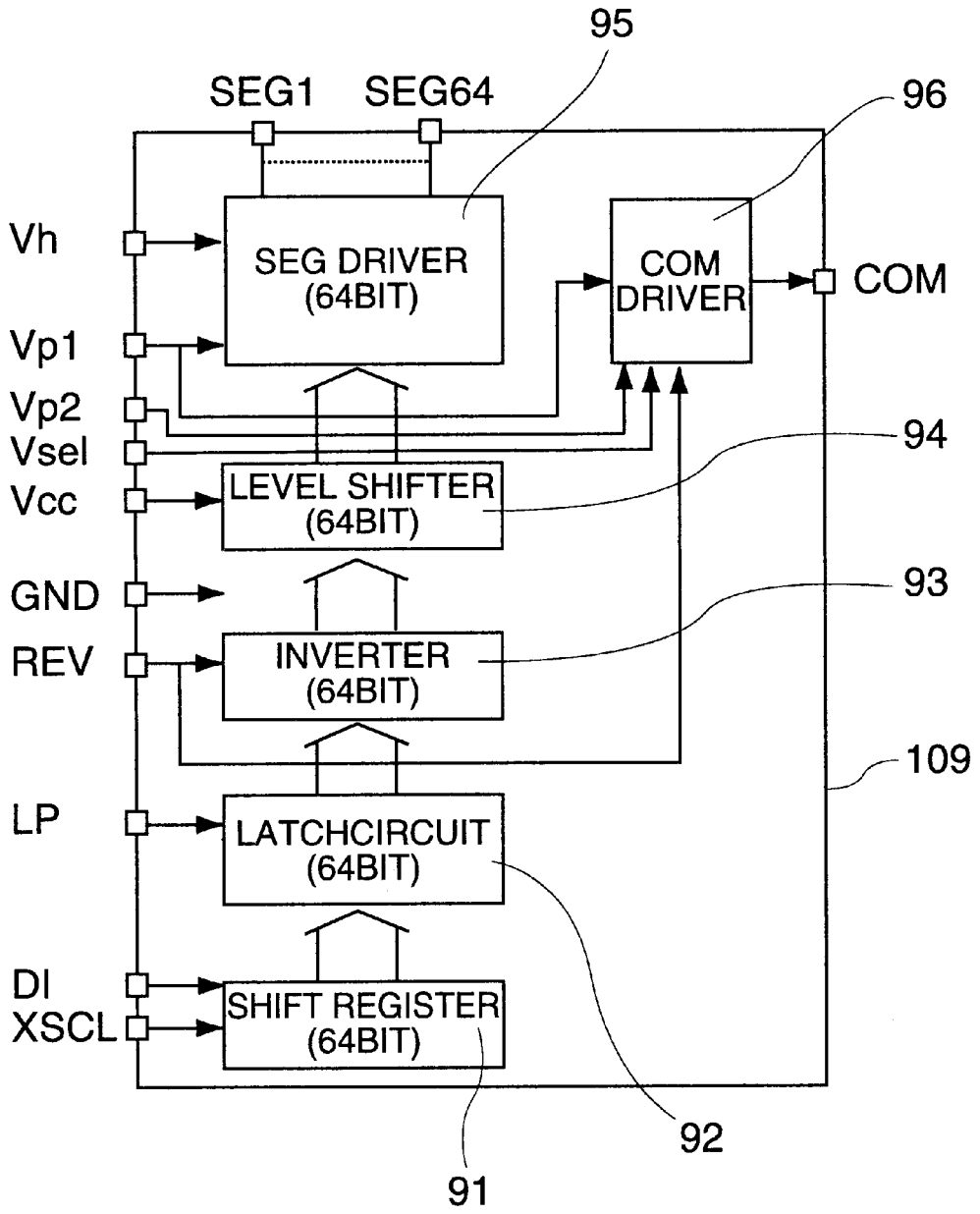
FIG. 10 is a block diagram of a head driver IC in the driver device shown in FIG. 9.

FIG. 10 is a block diagram of the inside of head driver IC 109 shown in FIG. 9. As noted above, head driver IC 109 operates according to logic circuit drive voltage Vcc and supply potential Vh of the high withstand voltage channel supplied from supply circuit 110. The head driver IC 109 switches between the drive voltage pulse Vp and ground potential GND according to the supplied drive control signal, and applies the selected potential to the opposing electrodes of the ink nozzle selected for ink discharge.

Head driver IC 109 is further described below as a 64-bit output CMOS high withstand voltage driver. Head driver IC 109 is further equivalent to the drive voltage applying means 210 shown in FIG. 2, which can be achieved by designing the head driver IC 109 to operate in 5 bit units.

Referring to FIG. 10, reference numeral 91 is a 64-bit static shift register for shifting up the 64-bit DI signal serial data input from logic gate array 5 based on XSCL pulse signal input (reference clock pulse) synchronized to the DI signal, and then storing the shifted data in an internal register. The DI signal is a signal for sending nozzle selection information for each of 64 nozzles as a serial data stream of on/off control bits.

Reference numeral 92 is a 64-bit static latch circuit for latching and storing the 64 bit data stored in shift register 91 as controlled by latch pulse LP. The latched data is then output to bit inverter 93. The static latch circuit 92 converts the serial DI signal to a 64-bit parallel signal for outputting the 64 nozzle control bits in segments.

Inverter 93 outputs the exclusive OR of signal input from static latch circuit 92 and the REV signal to level shifter 94. Level shifter 94 is a level interface circuit for converting the voltage level of the signal from inverter 93 from the voltage level (5 V or 3.3 V) of the logic circuit to the voltage level of the head driver (0 V to 45 V).

SEG driver 95 has a 64 channel transmission gate output. Based on the input from level shifter 94, SEG driver 95 outputs either drive voltage pulse Vp (=Vp1) or GND for segment outputs SEG1 to SEG64.

When Vsel is high (logic), COM driver 96 outputs either drive voltage pulse Vp (=Vp1) or GND from COM output for the REV input.

To achieve the drive method described above, drive voltage pulse Vp is connected to Vp1, and GND is connected to Vp2. The potential inversion control shown in FIG. 7 and FIGS. 8A to 8I can also be easily achieved by setting Vsel input low. Furthermore, the inkjet head setup process described above for handling increased viscosity ink can also be achieved by setting Vsel high to drive with polarity opposite the drive signal pattern, or alternate the drive field polarity.

Segment outputs SEG1 to SEG64 are electrically connected to terminals 10*b* of the individual electrodes 10 of the ink nozzles 11. COM output is electrically connected to the diaphragms 51 by way of common electrode terminal 26.

The XSCL, DI, LP and REV signals are logic voltage level signals, and are sent from gate array 105 to head driver IC 109.

By thus comprising head driver IC 109, even if the number of driven segments (nozzles) increases, the head nozzles can be easily switched between drive voltage pulse Vp and GND, and the potential inversion control method described above can be easily achieved.

Figure 11A:
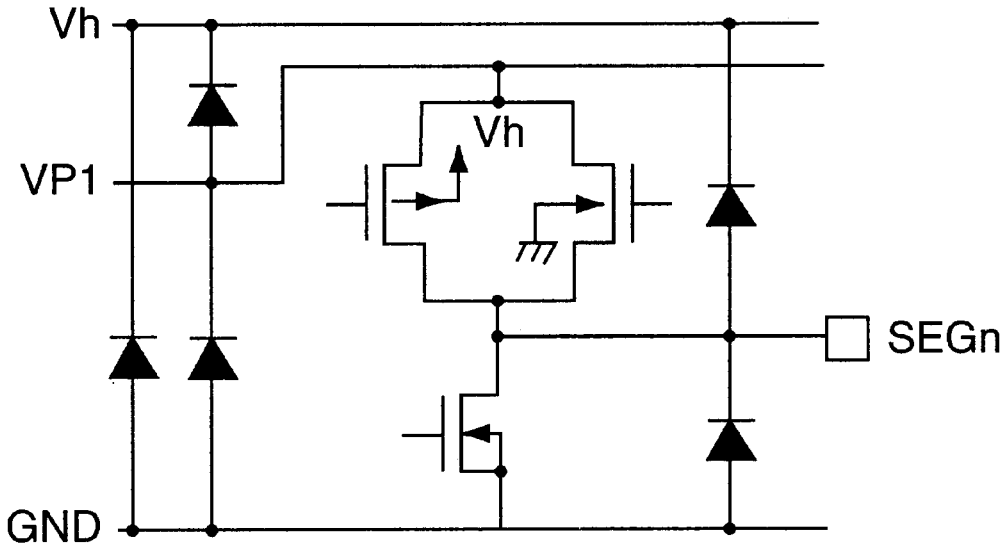
FIG. 11A is a block diagram of a SEG driver in the head driver IC shown in FIG. 10.
Figure 11B:
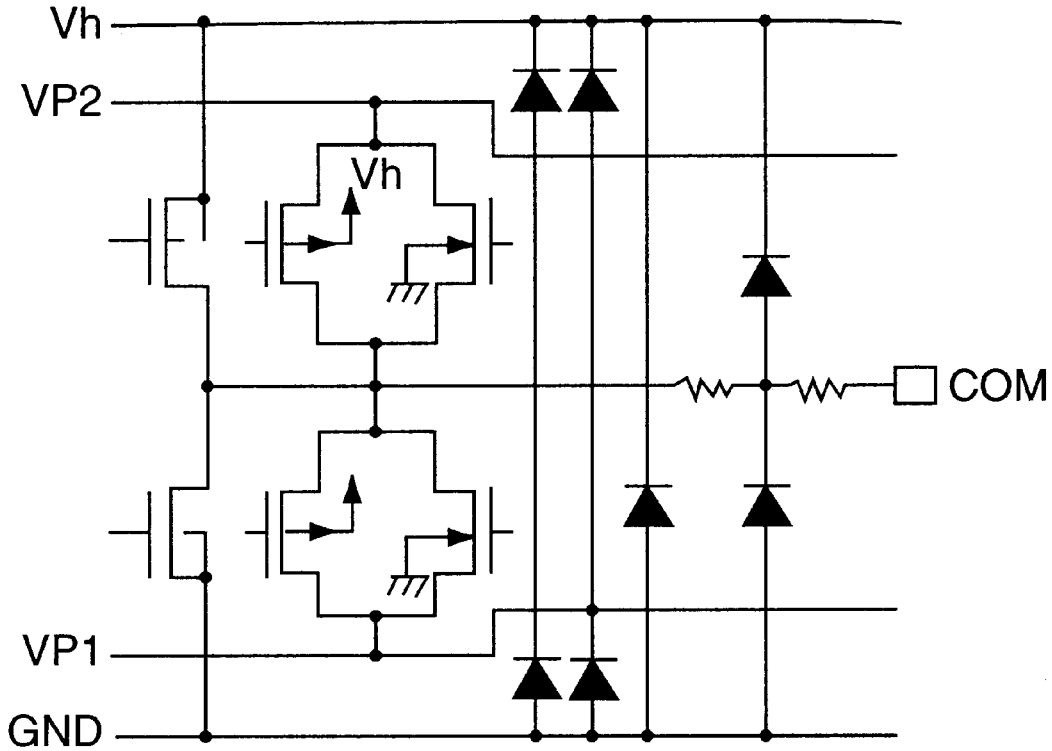
FIG. 11B is a block diagram of the COM driver in the same.

FIGS. 11A and 11B are circuit diagrams of the major internal parts of head driver IC 109. FIG. 11A shows the CMOS circuit design of a one bit driver in SEG driver 95, and FIG. 11B shows the CMOS circuit design of COM driver 96.

As noted above, SEG driver 95 outputs Vp1 or GND for each SEGn (where n=1, 2, . . . 64) output. COM driver 96 is designed to switch output to the COM output between Vh, Vp1, Vp2, and GND. Note that COM driver 96 is a two-way transmission gate.

By thus comprising SEG driver 95 and COM driver 96, a variety of electrostatic inkjet head drive control methods can be achieved, including the potential inversion control technique described with reference to FIGS. 8A to 8I for eliminating charge accumulation in the electrostatic actuator by inverting the potential of common electrode diaphragm 51 and individual electrode 10.

An Inkjet Printer

Figure 12:
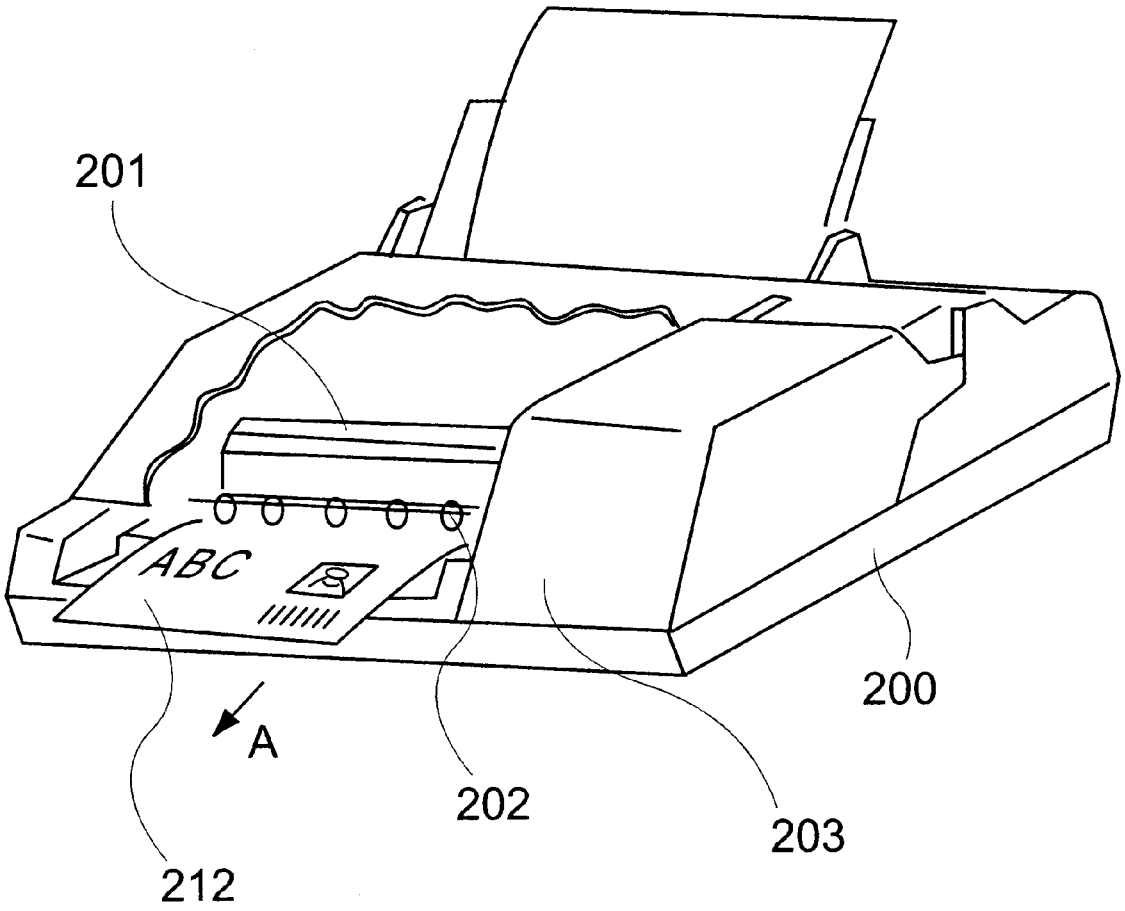
FIG. 12 is an oblique view of an inkjet printer in which the drive method of the present invention is employed.

FIG. 12 shows an exemplary inkjet printer 200 according to the present invention in which the drive method of the present invention is employed. This inkjet printer 200 has an electrostatic inkjet head 201. This electrostatic inkjet head 201 is a line type inkjet head and is basically identical to the electrostatic inkjet head shown in FIG. 1 to FIG. 3. It has 1440 ink nozzles arrayed in line opposite the printing paper 212 at a 70 mm pitch (360 dpi).

The inkjet printer 200 further has a paper transportation mechanism 202 for advancing the printing paper 212 in the direction of arrow A. Ink drops are discharged from the electrostatic inkjet head 201 synchronized to the transportation speed of printing paper 212, and the printer thus prints on the paper or other recording medium used in place of paper.

An ink supply mechanism is housed in ink supply mechanism compartment 203. The ink supply mechanism has an ink tank for storing ink (not shown in the figures), an ink circulation pump (not shown in the figures) for feeding ink to and recovering ink from the electrostatic inkjet head 201, and an ink tube (not shown in the figures) connecting the ink tank, circulating pump, and electrostatic inkjet head 201. These various parts of the ink supply mechanism are housed in the ink supply mechanism compartment 203.

This inkjet printer 200 further has a driver device 100 (driving means) for implementing the drive method described above to print. This driver device 100 thus controls driving the electrostatic inkjet head 201, transportation mechanism 202, and ink supply mechanism of the ink supply section to print data received from a data input device, such as a bar code scanner or other device connected directly thereto or indirectly by way of a network, for example.

It should be noted that while the electrostatic inkjet head 201 of this embodiment is described as a line type head that is held stationary for printing on a printing paper 212 passing thereby, it will be obvious that the present invention can also be applied to other types of inkjet printers, including serial inkjet printers that print by scanning the recording medium with the inkjet head and discharging ink drops to the medium synchronized to advancement of the medium.

An inkjet printer according to the present invention can thus achieve high resolution, precise printing because it uses a high density electrostatic inkjet head 201 driven by a driver device 100 according to our invention to print. It can also achieve high speed, high resolution printing by means of simple control and few scans by the electrostatic inkjet head.

It should be noted that we have described the drive method of our invention using an electrostatic inkjet head by way of example only, and our invention can also be applied to good effect with other types of inkjet heads having the diaphragm inside the pressure chamber. More particularly, our invention can also be used to drive piezoelectric elements using the method shown in FIG. 16 of Japanese Unexamined Patent Application (kokai) 9-314837, for example.

As we have described above, an electrostatic inkjet head drive method and device of our invention drives the diaphragms of both driven (discharge or first ink nozzles) and non-driven (non-discharge or second ink nozzles) ink nozzles to contact the individual electrode of the ink nozzle, and maintains contact between the diaphragm and individual electrode of the non-driven nozzles while releasing the diaphragm of the driven ink nozzle to discharge ink.

This sets the compliance of the ink pressure chambers of the non-discharge ink nozzles low, and thereby reliably prevents or suppresses deformation of the partitioning walls separating the ink pressure chambers of the driven (discharge) and non-driven (non-discharge) ink nozzles. Pressure crosstalk through the partitioning walls is thus prevented or suppressed, and a loss of ink discharge performance due to such crosstalk is thus reliably prevented or suppressed.

It is therefore possible, by using the drive method and drive device of our invention, to achieve a high density inkjet head without incurring a loss of ink discharge performance, and thus easily print with high resolution and precise print quality.

It is also possible using the drive method and device of our invention to design a high density inkjet head without making the driver device more complicated or reducing print speed.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A drive method for an electrostatic inkjet head having at least first and second ink pressure chambers separated by a partitioning wall, first and second ink nozzles communicating respectively with the first and second ink pressure chambers, first and second diaphragms that are flexibly displaceable and each forming part of a wall of the first and second ink pressure chambers, respectively, and first and second individual electrodes opposing said first and second diaphragms, respectively, comprising:

applying a drive voltage between said first diaphragm and said first individual electrode to flexibly displace said first diaphragm toward said first individual electrode;

a second diaphragm attracting step of applying a drive voltage between said second diaphragm and said second individual electrode to flexibly displace said second diaphragm toward said second individual electrode and maintain contact between said second diaphragm and second individual electrode; and a discharging step of flexibly displacing said first diaphragm to discharge an ink drop from the first ink nozzle.

2. A drive method for an electrostatic inkjet head as described in claim 1, further comprising a second diaphragm attraction holding step of maintaining contact between said second diaphragm and said second individual electrode throughout said discharging step of flexibly displacing said first diaphragm to discharge an ink drop from the first ink nozzle.

3. A drive method for an electrostatic inkjet head as described in claim 1, wherein said step of applying a drive voltage between said first diaphragm and said first individual electrode comprises a first diaphragm attracting step of attracting said first diaphragm to said first individual electrode and maintaining contact therebetween; and wherein the first diaphragm attracting step and second diaphragm attracting step are performed simultaneously.

4. A drive method for an electrostatic inkjet head as described in claim 3, further comprising an electrode contact restoring step of restoring contact between said first diaphragm and said first individual electrode after said discharging step; and wherein said second diaphragm attraction holding step includes a step of maintaining said second diaphragm in contact with said second individual electrode after said discharging step.

5. A drive method for an electrostatic inkjet head as described in claim 4, further comprising a release step of releasing said first and second diaphragms from contact with said respective first and second individual electrodes after said electrode contact restoring step, wherein said first and second diaphragms separate from said respective first and second individual electrodes and return elastically to a neutral position at a speed that will not cause ink discharge from the corresponding ink nozzle.

6. A drive method for an electrostatic inkjet head as described in claim 5, further comprising a residual charge elimination step after the release step for eliminating residual charge between said first diaphragm and first individual electrode and residual charge between said second diaphragm and second individual electrode.

7. A drive method for an electrostatic inkjet head as described in claim 1, further comprising a second diaphragm release step of releasing contact between said second diaphragm and said second individual electrode after said discharging step, and separating the second diaphragm from the second individual electrode and returning to a neutral position at a speed that will not cause ink discharge from the second ink nozzle.

8. A drive method for an electrostatic inkjet head as described in claim 1, wherein the electrostatic inkjet head further has at least a third ink pressure chamber not adjacent to the second ink pressure chamber, a third ink nozzle communicating with said third ink pressure chamber, a third flexibly displaceable diaphragm, and a third individual electrode opposite said third diaphragm, and further comprising controlling and driving said third diaphragm identically to said second diaphragm.

9. A driver device for an electrostatic inkjet head having at least first and second ink pressure chambers separated by a partitioning wall, first and second ink nozzles communicating respectively with the first and second ink pressure chambers, first and second diaphragms that are flexibly displaceable and each forming part of a wall of the first and second ink pressure chambers, respectively, and first and second individual electrodes opposing said first and second diaphragms, respectively, said driver device comprising:

a controller for:

applying a drive voltage between said first diaphragm and said first individual electrode to flexibly displace said first diaphragm toward said first individual electrode;

applying a drive voltage between said second diaphragm and said second individual electrode to flexibly displace said second diaphragm toward said second individual electrode and maintain contact between said second diaphragm and second individual electrode; and flexibly displacing said first diaphragm to discharge an ink drop from the first ink nozzle;

a switching device for switching a potential of the first and second diaphragms, and a potential of the first and second individual electrodes;

a drive pulse generator for producing a drive pulse; and said controller controls driving the first and second ink nozzles by changing the drive pulse generated by the drive pulse generator using the switching device.

10. An inkjet printer having an electrostatic inkjet head with a plurality of ink nozzles, a transportation device for moving the electrostatic inkjet head relative to a recording medium, and a driver for driving the electrostatic inkjet head synchronized to relative movement by the transportation device to print by discharging an ink drop from an ink nozzle by applying a drive voltage between a diaphragm and opposing fixed individual electrode to elastically deform the diaphragm through electrostatic force, wherein:

the driver attracts the diaphragm of a non-discharge ink nozzle to the opposing individual electrode, and elastically displaces the diaphragm of a discharge nozzle while maintaining contact between the diaphragm and individual electrode of the non-discharge nozzle to discharge an ink drop from the discharge nozzle, said non-discharge nozzle being an ink nozzle from which ink is not discharged, and said discharge nozzle being an ink nozzle from which ink is discharged.

11. An inkjet printer as described in claim 10, wherein the driver establishes contact between the diaphragms and respective individual electrodes of the discharge and non-discharge nozzles, elastically displaces the diaphragm of the discharge nozzle from contact with the individual electrode, and thereby discharges an ink drop from the discharge nozzle.

12. An inkjet head having a nozzle opening, an ink pressure chamber communicating with the nozzle opening, a diaphragm that deflects to discharge ink in the ink pressure chamber from the nozzle opening, and a fixed member to which the diaphragm is fixed by application of an external force to the diaphragm, wherein:

the diaphragm is bent to discharge ink in the ink pressure chamber from the nozzle when ink is to be discharged from the nozzle opening, and when ink is to not be discharged from the nozzle opening, the diaphragm is maintained in fixed contact with the fixed member by the application of the external force.

13. A drive method for an inkjet head having a nozzle opening, an ink pressure chamber communicating with the nozzle opening, a diaphragm that deflects to discharge ink in the ink pressure chamber from the nozzle opening, and a fixed member to which the diaphragm is fixed by application of an external force to the diaphragm, comprising:

bending the diaphragm to discharge ink in the ink pressure chamber from the nozzle when ink is to be discharged from the nozzle opening, and when ink is to not be discharged from the nozzle opening, maintaining the diaphragm in fixed contact with the fixed member by applying the external force.

14. A method of driving an inkjet head having at least a first nozzle unit and a second nozzle unit, the first nozzle unit having a first pressure chamber, a first nozzle communicating with the first pressure chamber, a flexibly displaceable first diaphragm forming part of a wall defining the first pressure chamber, and a first actuator for displacing the first diaphragm so as to discharge an ink droplet from the first nozzle, and the second nozzle unit having a second pressure chamber, a second nozzle communicating with the second pressure chamber, a flexibly displaceable second diaphragm forming part of a wall defining the second pressure chamber, and a second actuator for displacing the second diaphragm so as to discharge an ink droplet from the second nozzle, wherein the first and second pressure chambers are separated by a first partitioning wall, the method comprising the steps of:

a) driving the first actuator to displace the first diaphragm from a neutral position into a displaced position so as to increase the volume of the first pressure chamber;

b) driving the second actuator to displace the second diaphragm from a neutral position into a displaced position so as to increase the volume of the second pressure chamber; and c) driving the first actuator to allow the first diaphragm to return to its neutral position at a first speed high enough to cause an ink droplet to be discharged from the first nozzle, while driving the second actuator to maintain the second diaphragm in its displaced position.

15. An inkjet head having a nozzle opening, an ink pressure chamber communicating with the nozzle opening, a diaphragm that deflects to discharge ink in the ink pressure chamber from the nozzle opening, and a fixed member to which the diaphragm is fixed by application of an external force to the diaphragm, and further comprising:

means for bending the diaphragm to discharge ink in the ink pressure chamber from the nozzle when ink is to be discharged from the nozzle opening, and means for maintaining the diaphragm in fixed contact with the fixed member by the application of the external force when ink is to not be discharged from the nozzle opening.

* * * * *